US007096666B2

(12) United States Patent
Fay

(10) Patent No.: US 7,096,666 B2
(45) Date of Patent: Aug. 29, 2006

(54) AIR-COOLED CONDENSING SYSTEM AND METHOD

(75) Inventor: H Peter Fay, Solana Beach, CA (US)

(73) Assignee: Gea Power Cooling Systems, LLC, San Diego, CA (US)

( * ) Notice: Subject to any disclaimer, the term of this patent is extended or adjusted under 35 U.S.C. 154(b) by 0 days.

(21) Appl. No.: 11/256,307

(22) Filed: Oct. 21, 2005

(65) Prior Publication Data

US 2006/0086092 A1 Apr. 27, 2006

Related U.S. Application Data

(60) Provisional application No. 60/621,386, filed on Oct. 21, 2004.

(51) Int. Cl.
*F01B 31/16* (2006.01)

(52) U.S. Cl. ..... 60/685; 60/688; 60/690; 165/112; 165/913

(58) Field of Classification Search ..... 60/685, 60/688, 690; 165/111, 112, 113, 144, 913
See application file for complete search history.

(56) References Cited

U.S. PATENT DOCUMENTS

| | | | | |
|---|---|---|---|---|
| 3,185,213 | A * | 5/1965 | Wartenberg | 165/124 |
| 3,229,722 | A | 1/1966 | Kritzer | |
| 3,289,742 | A * | 12/1966 | Niemann | 165/111 |
| 3,556,204 | A | 1/1971 | Dehne | |
| 3,612,172 | A | 10/1971 | Dohnt | |
| 3,710,854 | A | 1/1973 | Staub | |
| 3,880,231 | A | 4/1975 | Gauthier | |
| 4,190,102 | A | 2/1980 | Grez | |
| 4,815,296 | A | 3/1989 | Amir | |
| 4,909,309 | A | 3/1990 | Palfalvi et al. | |
| 5,275,233 | A | 1/1994 | Little | |
| 5,323,851 | A | 6/1994 | Abraham | |
| 5,632,329 | A | 5/1997 | Fay | |
| 5,653,281 | A | 8/1997 | Berg et al. | |
| 5,765,629 | A | 6/1998 | Goldsmith et al. | |
| 6,142,223 | A | 11/2000 | Bodas et al. | |
| 6,332,494 | B1 | 12/2001 | Bodas | |
| 6,588,499 | B1 * | 7/2003 | Fahlsing | 165/231 |

FOREIGN PATENT DOCUMENTS

| | | |
|---|---|---|
| DE | 78 12 373 | 3/1979 |
| EP | 0 617 250 A2 | 9/1994 |

(Continued)

*Primary Examiner*—Hoang Nguyen
(74) *Attorney, Agent, or Firm*—Gordon & Rees, LLP

(57) ABSTRACT

An air-cooled condenser has a first stage comprising both a K and a D section with fin tubes fed with steam at both ends, and a second stage comprising a D section. Each core tube in the first stage has at least one extraction channel at the trailing edge of the core tube located in an unfinned section of the core tube and separated from the main section of the core tube by a rib or baffle. Extraction channels may be provided at both the leading and trailing edges or rounded ends of the core tube, or at the trailing edge only. Openings in the rib connect at least a central portion of the main section to the extraction channel. The upper end of each extraction channel of each core tube is connected via an extraction passageway and transfer duct to the lower ends of the D-section fin tubes. The D-section creates a strong suction action to draw steam and non-condensibles out of the first stage.

37 Claims, 26 Drawing Sheets

FOREIGN PATENT DOCUMENTS

| | | |
|---|---|---|
| EP | 0 780 652 A2 | 6/1997 |
| GB | 2 017 894 A | 10/1979 |
| WO | WO 98/33028 | 7/1998 |

* cited by examiner

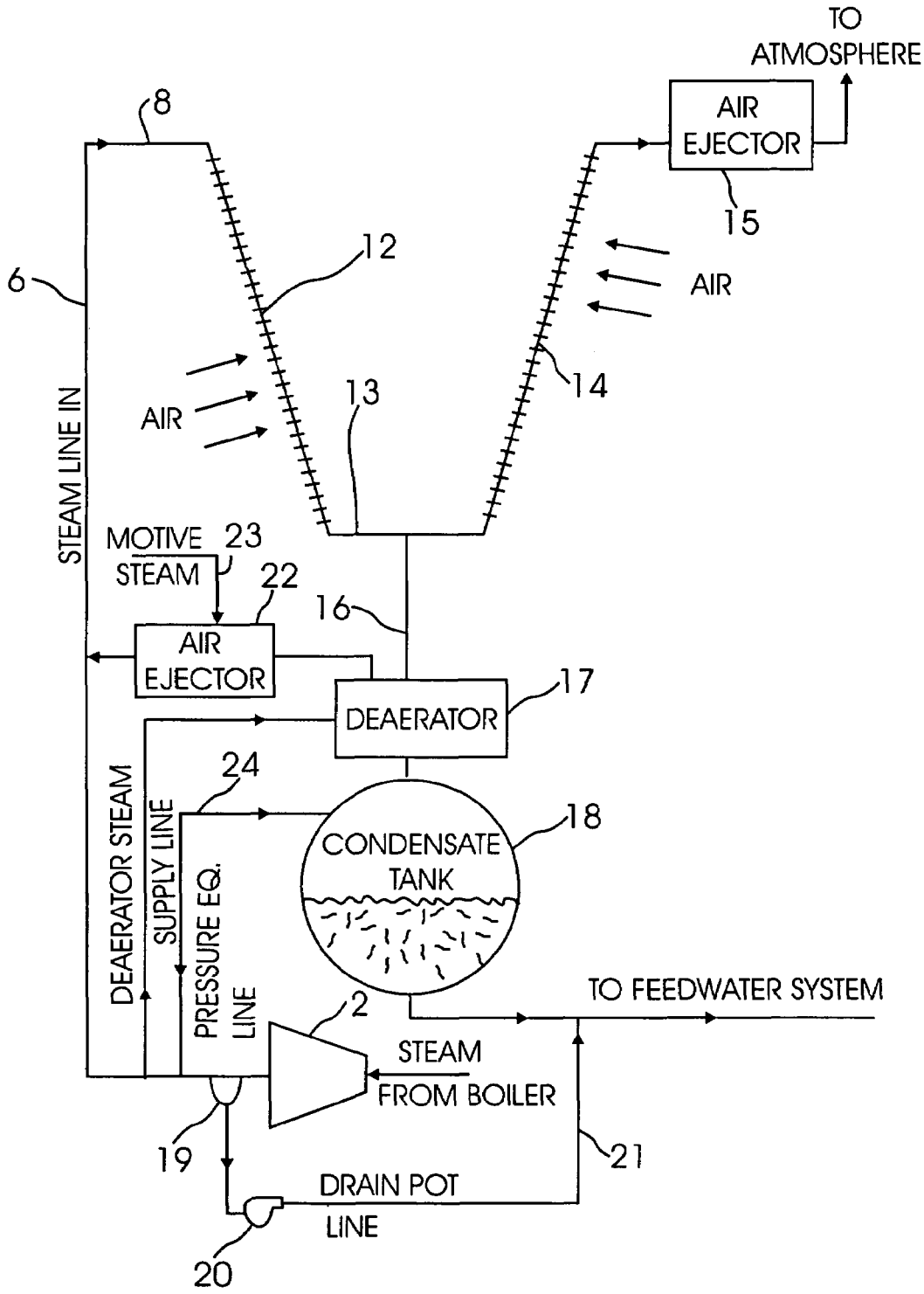
Fig. 1 - PRIOR ART

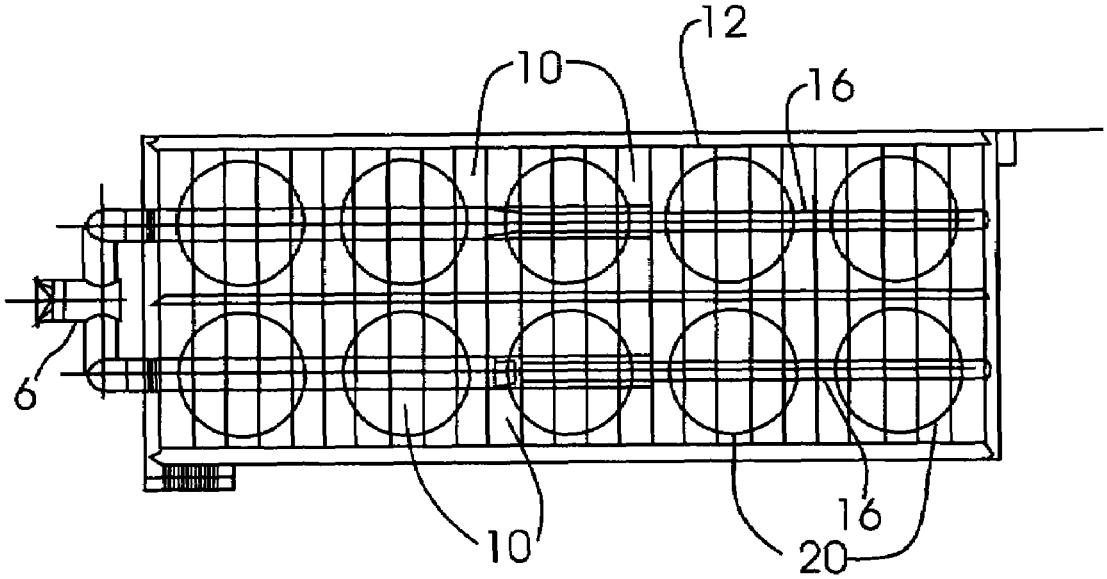
Fig. 2A - PRIOR ART
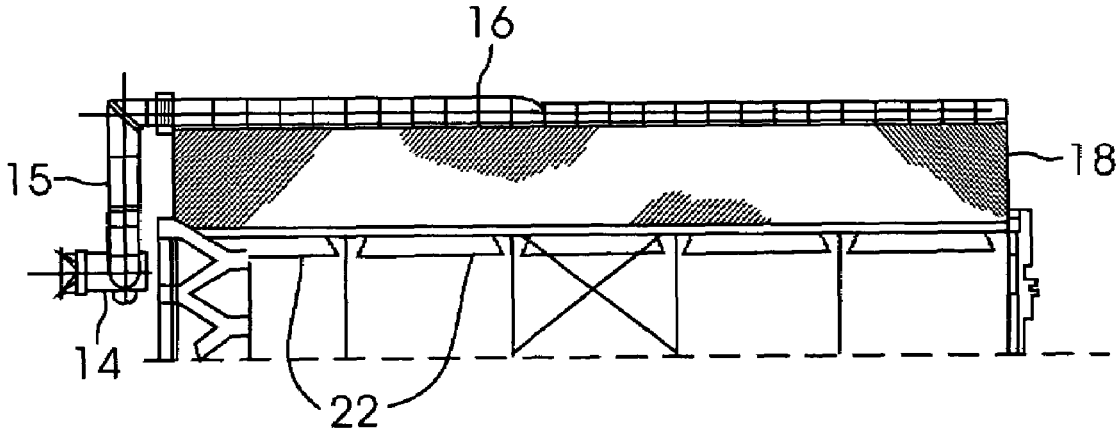
Fig. 2B - PRIOR ART 44
48

44
71
36
70
37
38
75
72
AIR FLOW 70
71
72
75

48
70
71
72

AIR-COOLED CONDENSING SYSTEM AND METHOD

CROSS REFERENCE TO RELATED APPLICATIONS

This application claims the benefit of priority of U.S. Provisional Application No. 60/621,386 filed Oct. 21, 2004, which is incorporated herein by reference in its entirety.

BACKGROUND OF THE INVENTION

This invention relates to air-cooled condensing systems and methods and more particularly to a system that is thermodynamically more efficient and simpler in physical execution than current state of the art air-cooled condensing systems.

Numerous condensing process arrangements have been introduced into the air-cooled condenser (ACC) industry since their introduction in the 1930's. Most did not survive and over time one system gained predominance in the industry. This system employed a single pressure, series flow, two-stage condensing process. The first stage was arranged for parallel flow of steam and forming condensate and was referred to as a condensing (or K) section. The second stage was arranged for counter flow of steam and condensate and was referred to as a dephlegmator (or D) section. In this prior condensing system, the entire condensing process takes place at a nearly constant, or single, pressure. These systems are commonly referred to in industry as K-D type. Many hundreds have been installed worldwide in all extremes of climatic conditions demonstrating reliability over many decades of operation.

The main reason for the adoption of the K-D system as the industry standard was because it offered reliable performance over a wide range of climatic extremes along with reasonably efficient condensing performance when employed in conjunction with multi-row fin tube heat exchangers, the only type available at the time. Cooling air entering a multi-row fin tube heat exchanger steadily increases in temperature as it traverses in the cross-flow direction from the first to the last fin tube row resulting in a decrease in row-to-row condensing rates. This causes premature completion of condensation in the first tube rows of the heat exchanger. As a consequence portions of the first rows of tubes fill with non-condensibles, commonly referred to as "dead zones", with a resultant total loss of heat exchange where this condition is present. Furthermore, the presence of dead zones presents a strong potential for freeze-up and damage to the tubes during cold weather operation. Such events can result in severe economic consequences. To combat this problem and achieve more uniform condensing rates in multi-row exchangers, designers incorporated variable fin spacings on the tubes with the fin pitch set steadily tighter from the first to the last row. This however only partially mitigated the presence of "dead zone" and it also reduced the amount of fin surface that could be deployed because the fins in the first rows could be only loosely pitched.

The two-stage K-D condensing process referred to above was devised in order to overcome the problems of dead zones in multi-row fin tube heat exchangers. In this process steam first enters the K section heat exchangers from above. By limiting the length of the K tubes and by properly modulating airflow, condensation is not allowed to complete in this section and some steam exits all tube rows at the bottom under all operating conditions. However, the conventional K-D condensing process has other problems. Condensate draining from the K section flows parallel to the downward flowing steam and therefore has a very short residence time in the K tubes. Because it flows in the bottom of the tubes, it is in contact with the coldest metallic portions of the tubes. This results in some sub-cooling of the condensate. The condensate is then routed to the condensate tank in a system of drainpipes that are exposed to cold air. This causes further sub-cooling of the condensate. Subcooling of condensate is deleterious because it decreases thermodynamic efficiency and, more importantly, increases the dissolved oxygen content of the condensate. Dissolved oxygen in the condensate creates serious corrosion problems in the overall steam cycle. Separate condensate deaerators are frequently incorporated to control the amount of subcooling occurring in K-D condensing systems, adding to the complexity and cost of the system.

Steam leaving the K section is collected in a header and then introduced from below into the second stage D section. The size of the D section can vary between as little as 8% to as much as 25% of the overall deployed condenser heat transfer surface. Condensation finally completes near the very top of the D section with the remaining interior tube volume being filled with non-condensibles. These are continuously removed by ejection equipment. All condensate formed in the D section drains downward in direct contact with and counter to the direction to the up-flowing steam. This arrangement results in a reliable highly freeze-proof condensing system. Subcooling of condensate in the D section is much less than in the K section because of increased residence time and increased contact from turbulence with up flowing steam. Although the K-D system meets the crucial requirement of minimizing unwanted "dead zones" in the condenser and providing reliable operation in extreme cold weather conditions, inherently high internal steam side pressure drops degrade its performance. These result from the fact that the steam must pass in series through two stages of fin tubes plus a steam transfer header, producing considerable friction losses plus additional turning and acceleration losses leaving and entering the two sets of fin tubes. These parasitic pressure losses produce a corresponding drop in the saturation temperature of the steam, which reduce the temperature difference potential between steam and cooling air, and thus the efficiency of the heat exchangers.

The steam path between the turbine and start of condensation in the K sections is frequently torturous and long. Typically the associated steam ducting involves four 90-degree turns, lengthy laterals, risers and upper distribution ducts before the steam enters the fin tubes. This is both costly and again depresses the saturation temperature of the steam due to the accompanying pressure drops, thereby degrading heat exchanger performance for the same reasons as noted above. The only way to compensate for these parasitic losses up to now has been to increase the physical size of the ACC.

In addition to the requirement for the above noted condensate deaerator, condensate drain lines and steam transfer header, several additional features must typically be incorporated in K-D systems for proper operation. These additional features include a pressure equalizing line between turbine exit and the condensate tank, a drain pot plus transfer pumps and piping to continuously drain condensate out of the main steam duct, a condensate tank to collect the condensate draining from the transfer headers, and condensate drain piping insulation and heat tracing to prevent freezing during cold weather operation.

In the last fifteen years much larger single row fin tubes have become commercially available and are now the industry standard because of their improved economics. The advent of the single row fin tube bundle represented a milestone in the evolution of ACC's in that the problem of variable-condensing rates in multiple tube rows is eliminated. It also permits the deployment of the densest possible fin pitch resulting in maximum deployment of heat exchange surface per unit of exchanger face area.

SUMMARY OF THE INVENTION

It is an object of the present invention to provide a new and improved air-cooled condensing system that is more compact, more efficient, less costly, and easier to operate.

According to one aspect of the present invention, a condensing system is provided which condenses the steam in two series connected stages. The first stage is comprised of both a K and D section arranged in parallel. The second stage is a D section which draws steam and non-condensibles from the first stage and in which final condensation takes place. Both sections employ single row fin tube bundles. The second stage is much smaller than the first being around 5 to 10% of the size of the first stage. Both condensing stages are served by independent air moving systems.

Steam is fed to the first stage fin tubes from a steam distribution header. This header directly feeds steam into the first stage fin tubes from the bottom creating a dephlegmator (counterflow) condensing section in the lower half of the fin tubes. Simultaneously steam is also fed from the steam distribution header into the top end of the fin tubes via separate steam transfer pipes. Steam entering the fin tubes from the top flows downward creating a K (parallel flow) section in the upper half of the fin tubes. Thus steam enters both ends of the first stage fin tubes, finally meeting in the mid-zone of the tubes. The above noted transfer pipes are normally located on the air inlet (cold) side of the fin tubes with typically two transfer pipes being employed per condenser cell.

Condensate forming in both sections of the first stage fin tubes drains by gravity down the tubes in a common stream into the lower steam distribution header. From there it flows by gravity back against incoming steam into the main steam duct and finally into a condensate collection tank located beneath the main steam duct. The condensate tank forms an integral part of the main steam duct eliminating the need for separate condensate drain piping and a pressure equalizing line. This arrangement results in all condensate freely draining into the condensate tank without the need for drain pots, transfer pumps and associated piping.

As the condensate drains from the fin tubes, then into the distribution ducting and finally into the main steam duct, it continually flows in a direction counter to the incoming steam. This counterflow condition causes highly turbulent direct contact between the steam and condensate and also increases the residence time of the draining process. The result is that any initial subcooling present in the condensate is virtually eliminated as the condensate is heated in the draining process to a temperature marginally lower than that of the incoming steam. This results in high condensing process efficiency and also eliminates the need for a separate deaerator. The absence of any significant amount of subcooling in the condensate drives off virtually all dissolved oxygen present in the condensate, which reduces corrosion of ferrous materials in the entire steam cycle to negligible levels.

The core tubes employed in the fin tubes of the first stage are not round, as is normal practice in fin tube type heat exchangers. Rather the core tube is comprised of a narrow rectangular shaped flow channel with half-round ends. The fins are attached to the parallel sides of the core tube. In one embodiment of the invention, the core tubes are further modified by the incorporation of two integral stiffening ribs. These effectively create two additional flow channels in each tube, one at the air inlet side of the core tube and the other at the air exit side. Several small holes are incorporated in each rib in the mid-zone of the fin tube. These holes are positioned over a distance extending about one third of the total fin tube length. The holes permit passage of steam between the main center flow section of the core tube and the two side flow channels described above. At least one of the side flow channels acts as an extraction channel connected to a steam extraction duct for extraction of uncondensed steam and non-condensibles from the first stage fin tubes. In an exemplary embodiment, both side flow channels are extraction channels connected to the steam extraction duct. The side flow channels are placed in unfinned regions of the core tube to reduce condensation in these channels.

A single partitioned combination steam feed and extraction duct serves to both feed the center main sections of the core tubes and to extract steam and non-condensibles out of the small side channels. A header box connects the steam feed and extraction duct to the upper ends of the core tubes. The extracted steam is collected in the extraction side of the combination duct and transported to the second stage condenser.

In a second embodiment of the invention, each core tube in the first stage condenser is still provided with two integral stiffening ribs, but the mixture of steam and non-condensibles is extracted only from the side channel of the trailing edge of the core tube, i.e., the side facing away from the cooling air flow. The side channel on the leading edge may be smaller in cross-section than the extraction channel on the trailing edge, and the rib forming this channel is usually for tube strengthening purposes only. This channel acts as part of the overall K-D condensing portion of the core tube.

As previously noted, steam enters both ends of the first stage fin tubes. As the two streams flow toward each other into the center region of each tube a small amount of the steam and associated non-condensibles is extracted through the extraction channel. This steam enters the side flow channel or channels through the holes incorporated in the ribs and then flows upward into the extraction section of the combination duct on its way to the second stage condenser. Approximately 5 to 10% of all steam flowing into the first condensing stage is extracted in this manner. This results in first stage tubes that are full of steam and the virtual absence of stagnant pockets of non-condensibles, such as air, that create unwanted dead zones. Furthermore the relatively large amount of steam flowing in the leading and trailing edges of the core tubes serves to in effect heat trace the tubes thereby providing inherent freeze protection.

In another alternative embodiment, external extraction ports are provided on the trailing edge of each core tube in the central region of the tube. In this embodiment, the internal partitions or ribs in the core tube may be eliminated to leave a single flow channel in the core tube, or ribs may be provided for added strength and buttressing, with openings in the rib on the trailing edge to allow steam flow into the extraction ports. The extraction ports are connected to the D section by a suitable extraction pipe or pipes.

A key benefit derived from the twin feed arrangement utilized in the first stage condenser is that steam inlet velocities to the fin tubes are reduced by a factor of approximately two and the flow path length in the fin tubes is also reduced by a factor of two. These two effects in combination reduce steam side pressure drops within the core tubes to negligible levels. In fact the pressure drops are so low that proper steam side flow distribution cannot be assured. In order to remedy this problem, sufficient pressure drop is re-introduced by narrowing the width of the core tubes by approximately one half, thereby also reducing the cross-sectional flow area of the core tubes by an equivalent amount. This doubles the inlet velocities bringing them back into normal range while retaining the flow path length equal to half the overall length of the tube. Steam side pressure drop in the first stage fin tubes is thereby reduced to approximately half of previous levels which has the effect of increasing the effective saturation temperature of the steam with a corresponding increase in heat transfer efficiency.

Air-cooled condensers require extensive amounts of fin tube face area to perform their function and as a result occupy considerable amounts of plant area. Typically the fins occupy two thirds of the face area and the core tubes the remaining third. As noted above the twin feed arrangement reduces the width of the core tubes by a factor of approximately two. This has the effect of reducing overall face area by one sixth and thereby the overall size of air-cooled condenser by an equivalent amount. This physical reduction in size significantly reduces the cost of the air-cooled condenser while leaving thermal performance essentially unchanged.

The integral ribs incorporated in the core tubes in addition to creating the steam extraction channels serve an important second function which is to buttress the core tubes against vacuum induced collapsing forces. During normal operation the core tubes operate at very high vacuum levels that develop forces that incrementally reduce the width of the core tubes. The accumulation of these deflections can develop significant gaps between fin tube bundles. These gaps create paths for air to bypass the fin tubes and thus reduce the performance of the air-cooled condenser. Previously this bypass has been controlled by installing special air seals between fin tube bundles which was costly and labor intensive. The need for such air seals is precluded through the introduction of the integral ribs incorporated in the core tubes of the current invention by virtue of the fact that they directly react to the vacuum induced forces.

The second stage condenser is arranged as a dephlegmator with steam entering at the bottom of the fin tubes. The purpose of the second stage condenser is to develop a strong suction action to extract steam and non-condensibles out of the first stage. As this mixture flows upward in the second stage the non-condensibles are swept into the upper region of the second stage facilitating their final removal by conventional air ejection equipment. In order to control the amount of suction action developed by the second stage under all operating conditions, particularly cold weather operation, it is provided with its own dedicated air moving system.

BRIEF DESCRIPTION OF THE DRAWINGS

The invention will be better understood from the following detailed description of some exemplary embodiments of the invention, taken in conjunction with the accompanying drawings, in which like reference numerals refer to like parts, and in which:

FIG. 1 is a schematic representation of a typical prior art single pressure, two-stage K-D air-cooled condensing system;

FIG. 2A is a plan view of a prior art K-D air-cooled condensing system as applied in a forced draft arrangement;

FIG. 2B is a side elevation view of the prior art system of FIG. 2A;

DETAILED DESCRIPTION OF THE DRAWINGS

Figure 3:
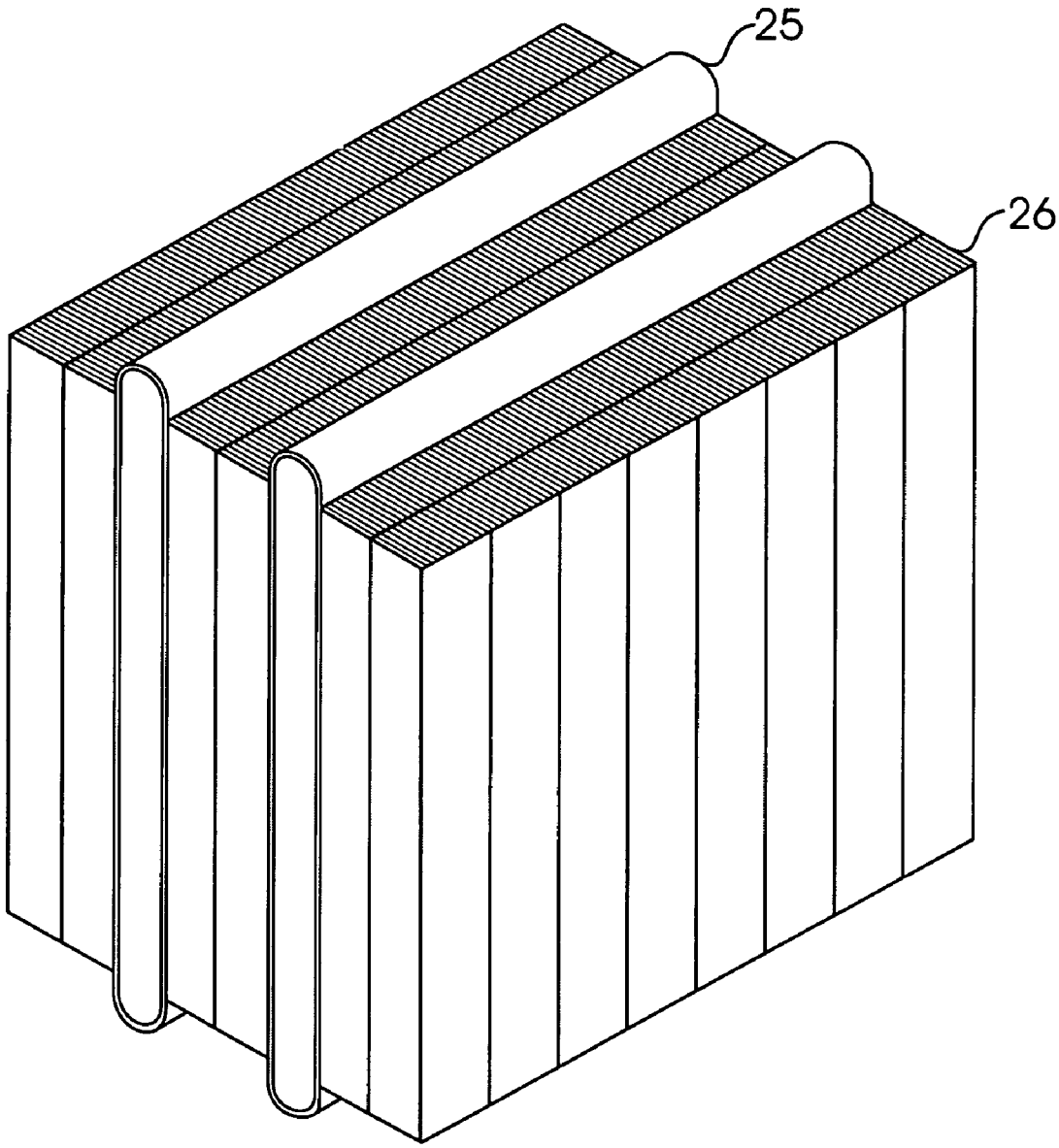
Fig. 3 PRIOR ART
FIG. 3 is an isometric view of typical prior art fin tubes.

FIGS. 1, 2A and 2B illustrate a prior art, conventional K-D type single pressure, two-stage condensing system. FIG. 1 is a schematic illustration of the system, while FIGS. 2A and 2B illustrate a typical condenser installation. Usually, a plurality of cells 4 are arranged next to one another in sections, with two or more sections within an air-cooled condenser installation 5. FIGS. 2A and 2B illustrate a two section, ten cell arrangement, with every section acted upon in parallel by exhaust steam fed from a main steam duct 6, connecting riser ducts 7; and upper steam distribution headers 8 for each condenser section. A wind wall 9 normally surrounds the entire installation above the air inlet. In the standard forced draft arrangement of FIGS. 2A and 2B, each condenser section is arranged as an A-frame with series connected K and D stages, with multiple fans 10 located below each condenser section which draw air in through inlet bells 11 below each condenser section.

The overall arrangement is illustrated schematically in FIG. 1. The main steam duct 6 feeds steam from the turbine 2 to the top of each K fin tube bundle 12. Most of the steam is condensed as it travels down each K fin tube. The remaining steam leaving the K bundles is collected in steam transfer headers 13 and routed to the D fin tube bundles 14 where it enters the bundles from the bottom. Non-condensibles are swept into the upper sections of the D bundles and are removed by air ejectors 15. All condensate is collected in the steam transfer headers 13 and is drained from there via drain pipes 16 to a deaerator 17, and then to a separate condensate tank 18, before being returned back to the power plant feed water system. Condensate forming in the main steam duct 6 is collected in a drain pot 19 and is then transferred by a pump 20 in a line 21 interconnecting the drain pot with the feedwater return line. The deaerator 17 requires a separate air ejector 22 with its own motive steam supply 23. A pressure equalizing line 24 is required between the main steam duct and the condensate tank 18 so that the vapor space in the condensate tank is essentially the same as in the main steam duct 6.

As is evident from the above description, the prior art design involves extensive ducting and piping to deliver steam to the point of condensation. In addition, steam being condensed in the D section must also first pass through the K section. This increases steam velocities in the K section significantly with attendant added pressure losses and reduction in the available log mean differential temperature (LMDT) between cooling air and steam. The steam exhausting from the turbine typically undergoes four ninety-degree turns in its path from the turbine to the upper steam distribution header 8. It also must flow to the top of the condenser installation via the riser ducts 7 and also through a long steam transfer header 13 before reaching the D section bundles 14. This creates considerable pressure drop, further reducing the efficiency of the heat exchange process.

The D-section, in the act of condensing steam, develops a powerful suction that draws steam out of the K-section. This also sweeps any non-condensibles present in the K section into the D-section and from there to the ejection equipment. The D-section is highly tolerant to the presence of non-condensibles (dead zone) in its upper region during freezing conditions, whereas the presence of dead zones in a K section would normally lead to ice formation and damage to the tubes. This is why the D-section's function of removing non-condensibles effectively out of the K section is so important.

The fin tubes of the prior art air-cooled condenser are comprised of long rectangular shaped core tubes 25, inside of which the steam flows, and fins 26 that are bonded to the external surfaces of the core tubes as shown in FIG. 3. Typically the core tubes are approximately 19 mm wide and the fins are 38 mm high, resulting in a fin tube pitch of 57 mm. The length of the fin tubes is variable but can exceed 10 meters. In order to maintain steam velocities and associated pressure drops within reasonable limits the cross-sectional area of the core tubes must be of appropriate size. Typically this results in core tubes that occupy approximately ⅓ of the heat exchanger's plan area as shown in FIG. 3. The fins are typically made of aluminum and the core tubes of carbon steel. They are metallically bonded to each other by specialty brazing methods.

Figure 4:
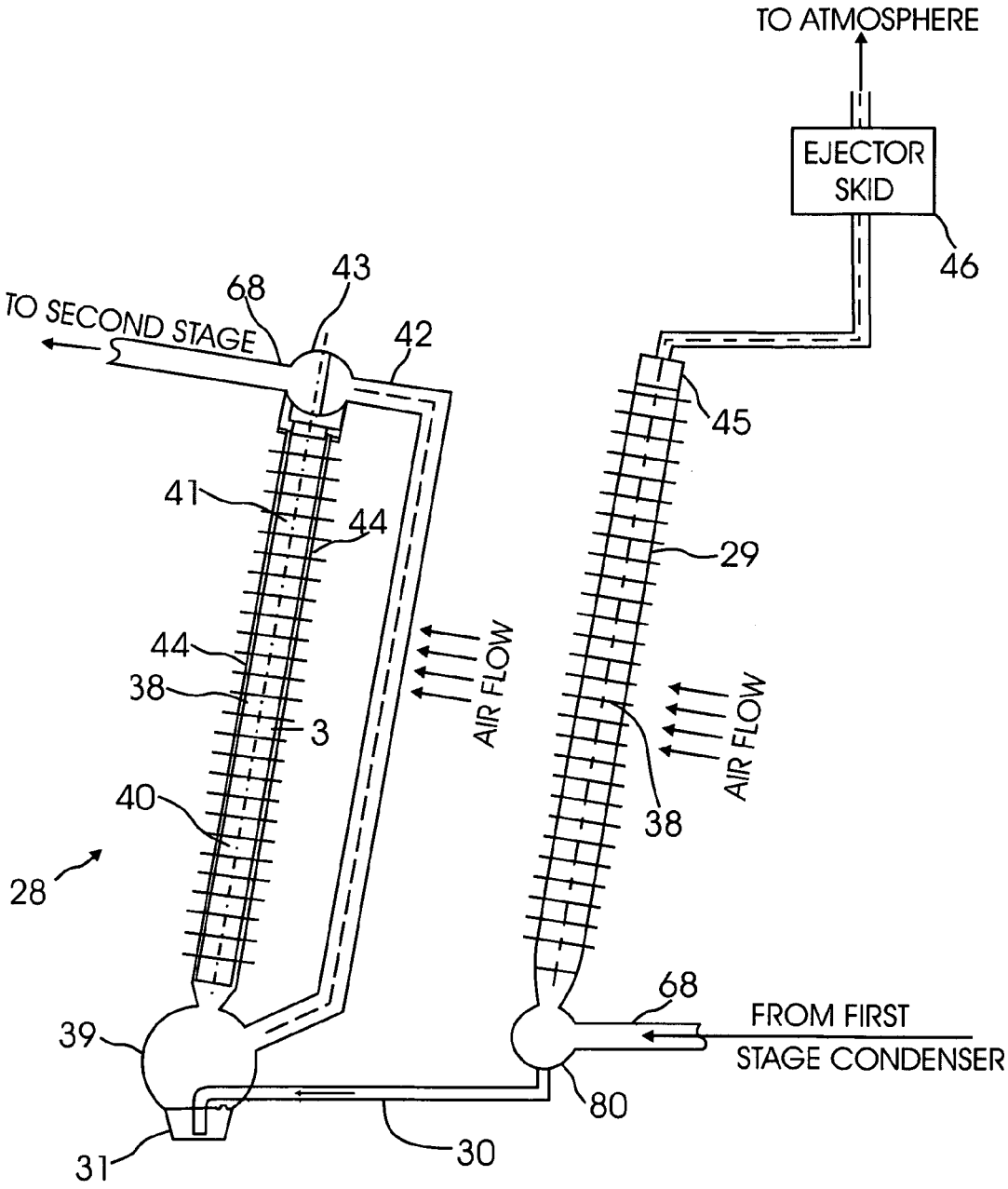
FIG. 4 is a simplified schematic of the two-stage condensing system employing a combination K and D section in the first stage and a D section in the second stage according to a first embodiment of the present invention.

FIGS. 4 to 11 illustrate a two-stage air-cooled condenser system according to a first embodiment of the present invention. The first stage 28 comprises a combined K and D section with flow arranged in parallel. The second stage 29 is a D section that draws steam and non-condensibles out of the first stage and in which final condensation takes place. Arrows in FIG. 4 represent the direction of cooling air flow across the two condensers.

FIG. 4 is a schematic representation of the condensing system wherein all steam is condensed in the first and second stage condensers 28 and 29 respectively. Steam to be condensed is delivered to the first condensing stage 28 by a steam distribution header 39 which directly feeds the D section 40 of the first stage from the bottom and the K section 41 of the first stage via a steam transfer pipe 42. Steam fed by the steam transfer pipe first enters a partitioned steam feed and extraction header 43 incorporated in the top of the bundles. This header distributes the incoming steam to the K section 41 of the first stage. Steam flowing into the first stage from both ends meets near the middle of the fin tubes 38. Each fin tube has a central condensing flow channel 3 and side flow or extraction channels 44 on each side of the central flow channel, as best illustrated in FIG. 5. Approximately 5 to 10% of all inflowing steam is extracted via steam/air extraction channels 44 that are an integral part of the fin tubes. The extracted steam, along with non-condensibles, is collected in the extraction side of the partitioned steam feed and extraction header 43 and then routed to a steam distribution header 80 at the bottom of the second stage D condenser 29 through transfer pipe 68 (only partially shown in FIG. 4). The steam present in the mixture is condensed in the second stage fin tubes 38 and the remaining non-condensibles are swept up the fin tubes into an upper collection header 45. A conventional air ejection system 46 removes the accumulating non-condensibles from the collection headers on a continuous basis and returns them to atmosphere.

All condensate formed in the first stage 28 drains by gravity down the fin tubes into the steam distribution header 39. In the case of the second stage condenser, the condensate is returned from header 80 via a condensate transfer pipe 30 to a loop seal 31 incorporated in the steam distribution header 39. The loop seal prevents steam from bypassing from the steam distribution header to the second stage condenser 29.

Figure 5B:
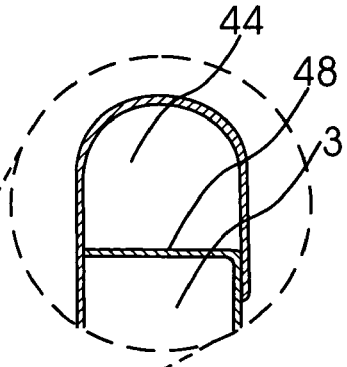
FIG. 5*b* is an enlarged detail of one end of the core tubes of FIG. 5*a* showing the internal partitioning rib.
Figure 5A:
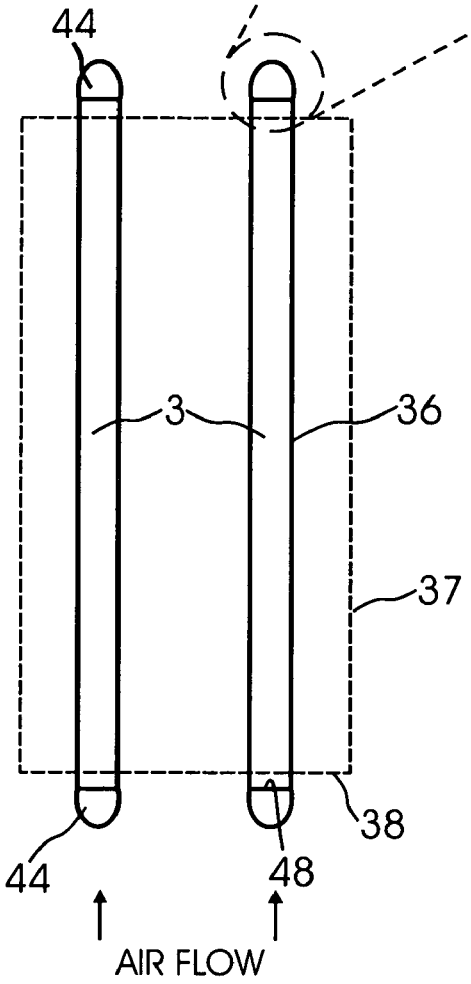
FIG. 5*a* is a cross-section of the fin tubes employed in FIG. 4.
Figure 5C:
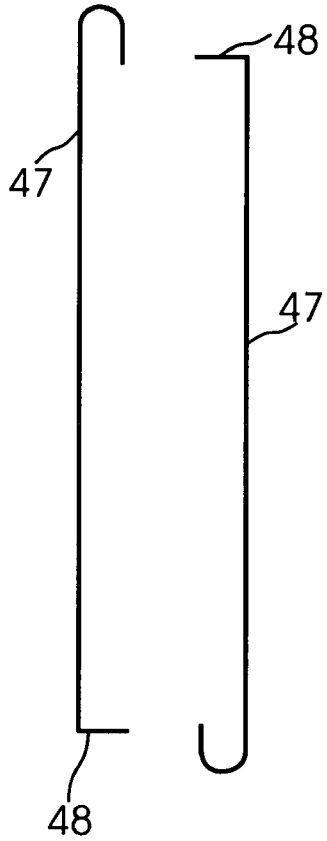
FIG. 5*c* illustrates the two identical sections which are connected to form a core tube.
Figure 6:
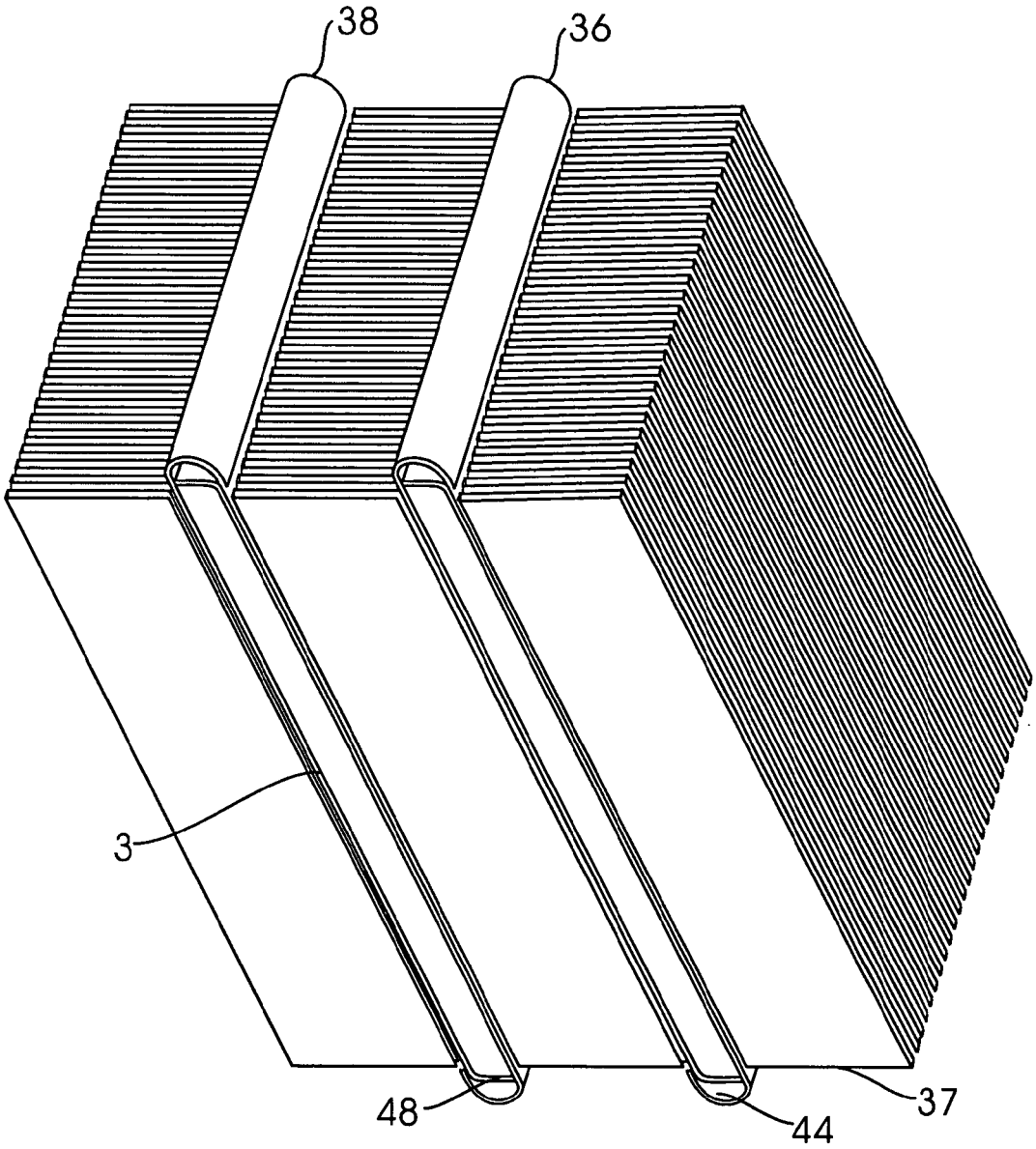
FIG. 6 is an isometric view of the fin tube of FIG. 5*a;*

FIG. 5*a* is a cross-sectional view of typical fin tubes 38 of the present invention. Each fin tube is of elongate cross section to form a relatively thin, rectangular central flow channel 3. In one example, the transverse thickness between opposite sides of each core tube 36 may be 11 mm and the height of the fins 37 may be 38 mm, resulting in a fin tube pitch of 49 mm, although these dimensions may be varied to provide a narrower fin tube with longer fins, if desired. In the exemplary embodiment of the invention, the core tube 36 is comprised of two identical formed sheet metal pieces 47 as shown in FIG. 5*c*. These two pieces are joined by weldment to form a single core tube 36 as shown in FIGS. 5*a* and 5*b*. As also shown in FIG. 5*b*, each sheet metal piece 47 incorporates a narrow transverse rib 48, which forms separate chambers 44 on both sides of the central flow channel 3 of the core tube when the two pieces are assembled. The length of the fins in the airflow direction extends to within 10 mm of the distance between the ribs 48. FIG. 6 shows an isometric view of the fin tube 38 of the present invention. As can be seen, the fins between adjacent core tubes are formed integrally as a single set of fins, rather than two sets of fins welded together at their junction, as in the prior art (see FIG. 3). However, the two stages of the condenser may alternatively use fin tubes constructed as in FIG. 3, or single fin tubes rather than fin tubes with integral or shared fins. In each alternative, the first stage integral or separate fin tubes will have core tubes constructed as illustrated in FIGS. 5 and 7. The length between opposite rounded ends of the fin tube is around 222 mm, while the length of the central finned section is of the order of 190 mm.

Figure 7A:
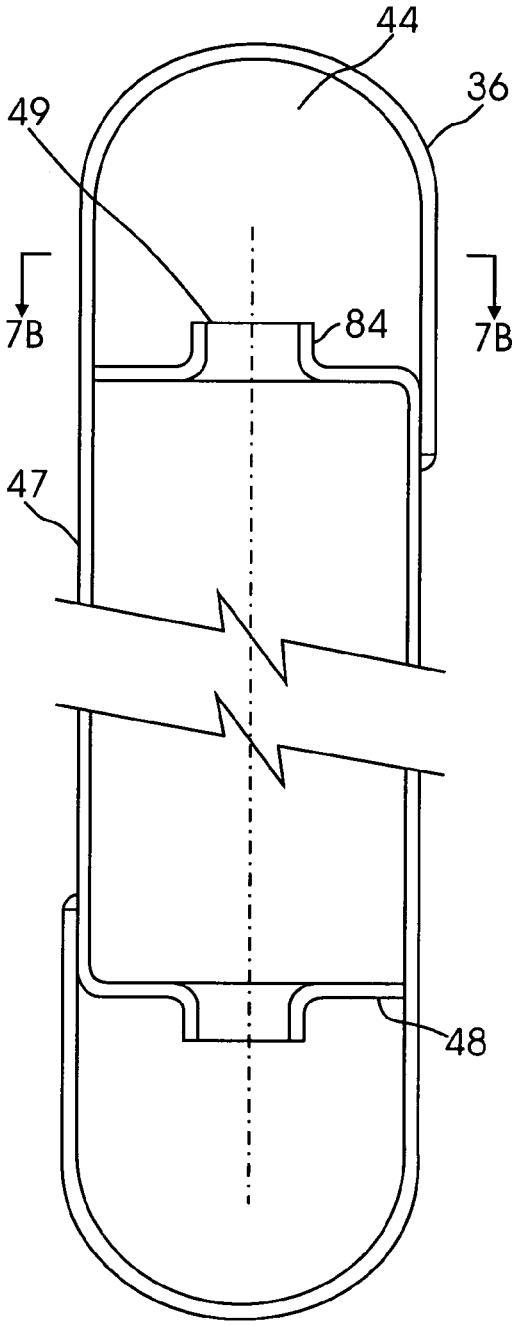
FIG. 7*a* is a cross-section of one of the core tubes of fin tubes in the K-D section of FIG. 5*a;*
Figure 7B:
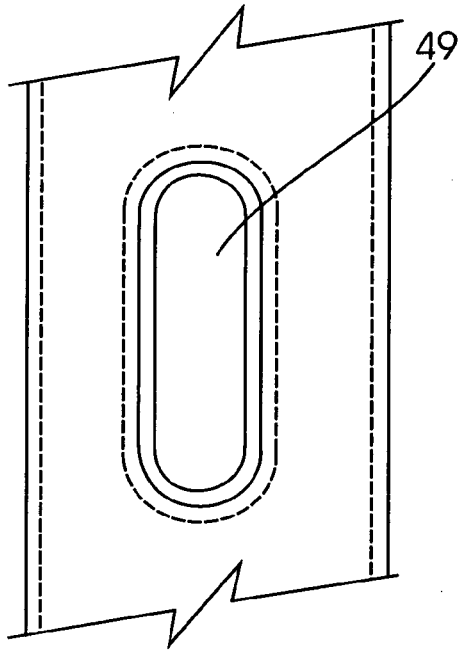
FIG. 7*b* is a plan view in the direction 7*b*—7*b* of FIG. 7*a* showing one of the oblong openings in the partitioning rib of FIG. 7*a;*
Figure 7C:
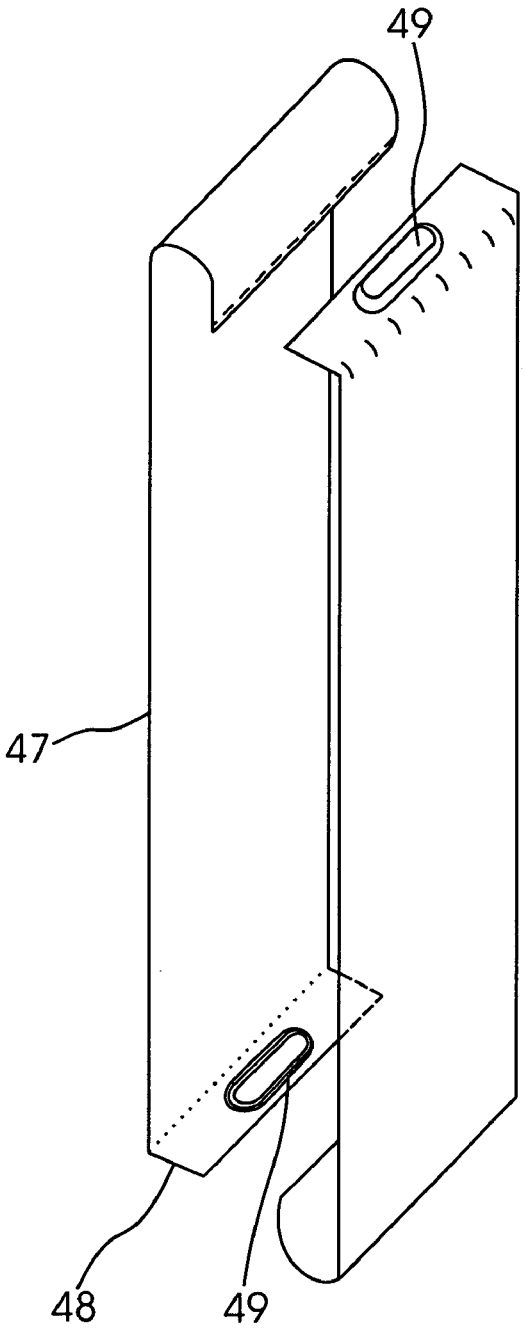
FIG. 7*c* is an isometric view of a portion of two core tube sections prior to connection to form the core tubes.
Figure 7D:
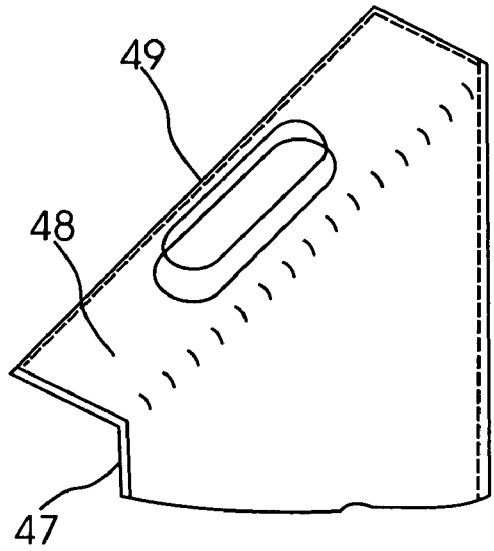
FIG. 7*d* is a detail of part of one core tube section showing one of the openings.

Five oblong openings 49 are incorporated in each rib 48. The configuration of an opening is shown in a cross-sectional view of the core tube 36 in FIG. 7*a* and in FIG. 7*b*. Isometric views of the oblong openings incorporated in the pieces 47 making up the core tube are shown in FIGS. 7*c* and 7*d*. The openings allow steam passage between the inner section of the core tube and the two outboard steam/air extraction channels 44 formed by the ribs 48. The openings 49 have a rounded contour around their perimeter forming a shallow dam or rim 84. The dam allows draining condensate to bypass the openings without interfering with the passage of steam.

Figure 8A:
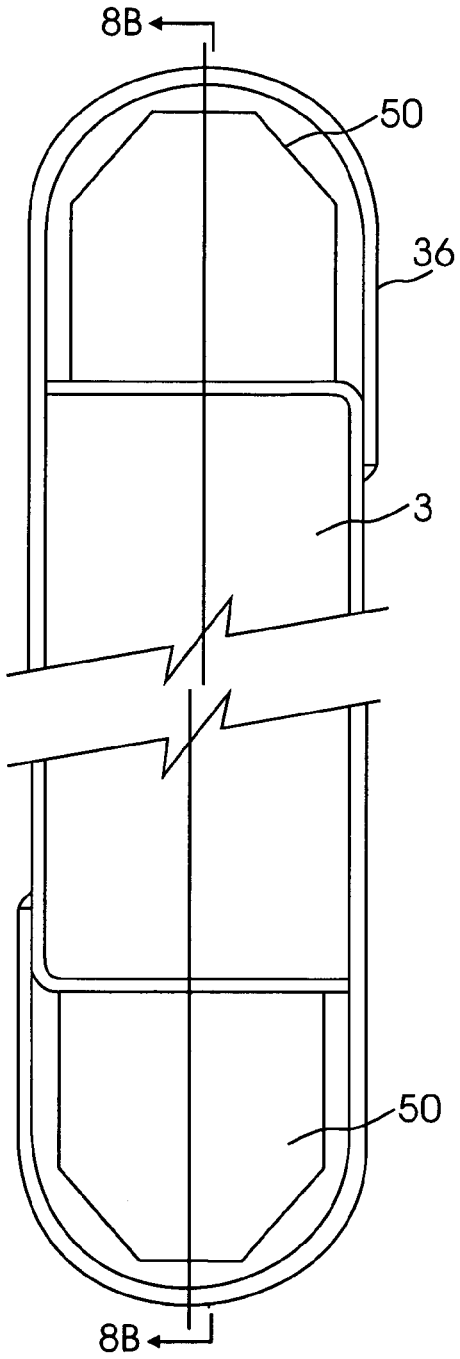
FIG. 8*a* is a cross-sectional view through a core tube to illustrate flow blocking tabs incorporated in the core tube.
Figure 8B:
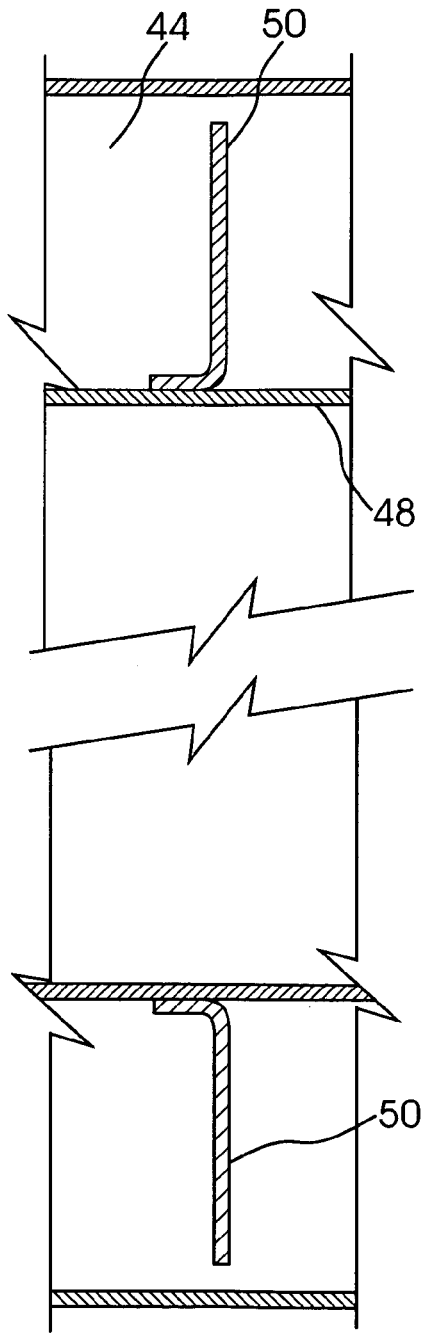
FIG. 8*b* is a cross-sectional view on lines 8*b*—8*b* of FIG. 8*a;*

The two extraction channels are connected to the lower distribution header 39 at their lower end. A tab 50 is incorporated in each side channel 44 of the core tube as shown in FIGS. 8*a* and 8*b* at a location approximately one third of the length of the channel from its lower end. The tabs are angle sections that are welded to the ribs 48 prior to welding the two core tube sections together. The tabs block steam flow upwardly from header 39 through the outer chambers at their point of location, but allow condensate to drain past them and down into the steam distribution header 39.

Figure 9A:
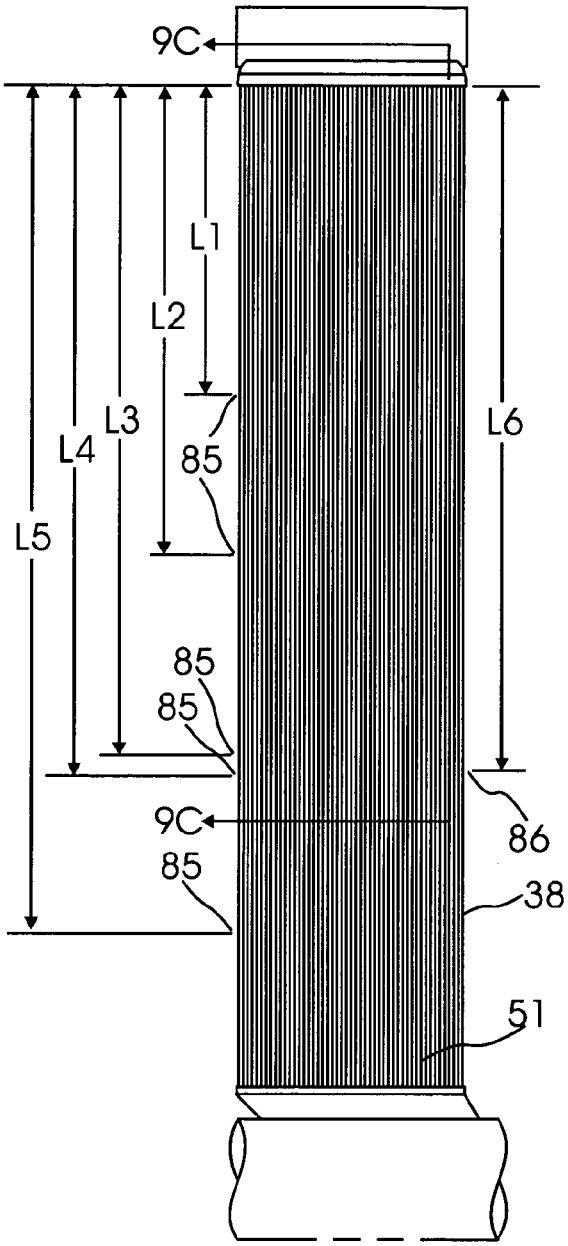
FIG. 9*a* is a front view of an entire fin tube bundle.
Figure 9B:
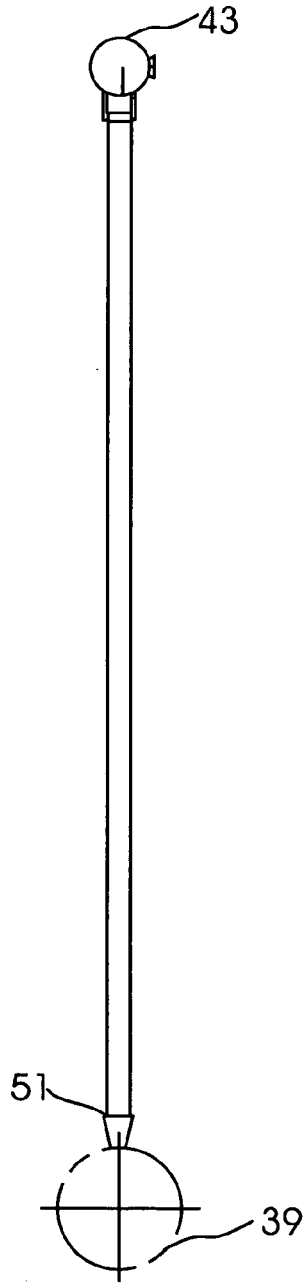
FIG. 9*b* is a side view of the fin tube bundle of FIG. 9*a;*
Figure 9C:
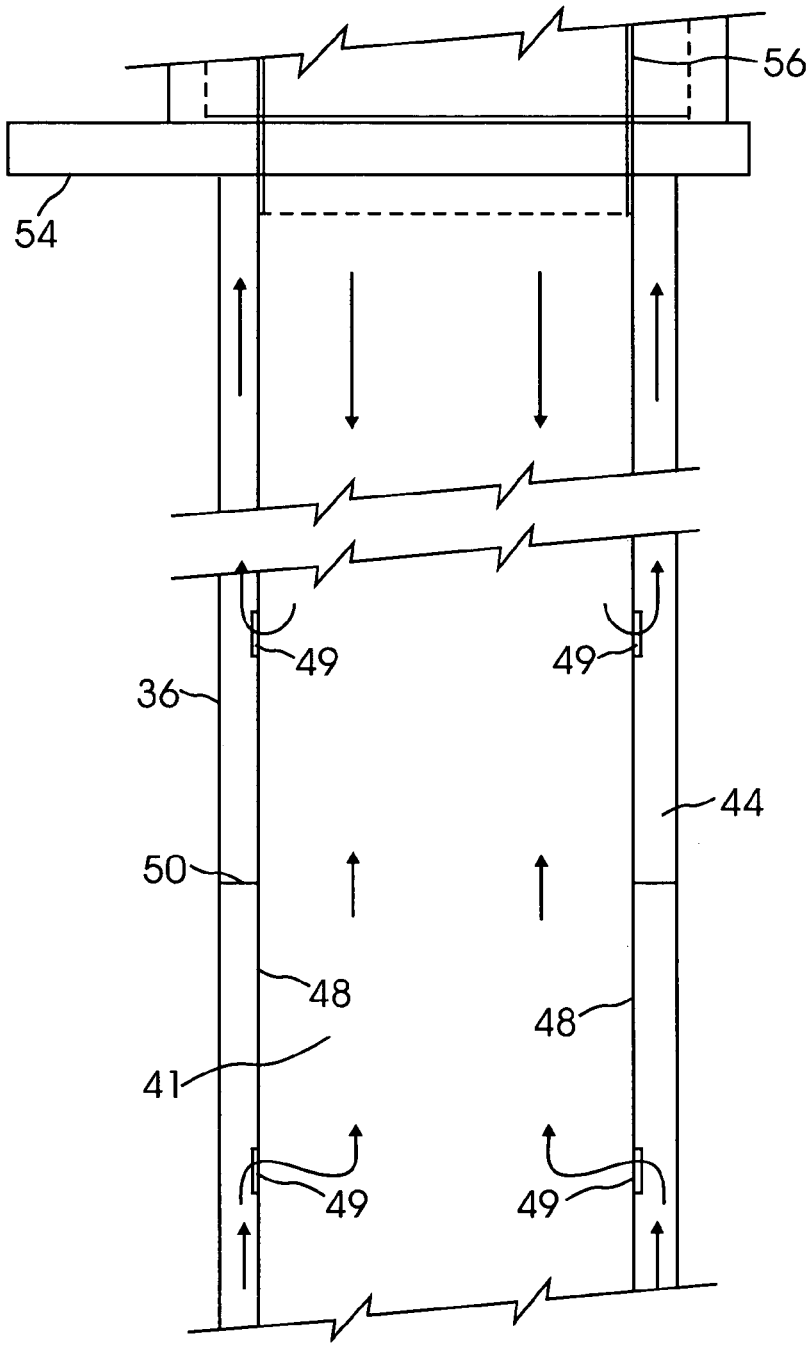
FIG. 9*c* is a cross-sectional view of the central portion of one of the extraction channels, taken along the line 9*c*—9*c* of FIG. 9*a* and illustrating the locations of the extraction openings and closure tabs.

The location of the five openings 49 and the tab 50 in each side channel 44 are illustrated in FIG. 9*a*. FIG. 9*a* is a front view of a typical first condensing stage fin tube bundle 51 of the condensing system. Ten oblong openings 49 with five per side are incorporated in the ribs 48 of each core tube 36. The centerline location 85 of each opening 49 is indicated on the left-hand side of FIG. 9*a*, while the location 86 of each tab 50 is indicated on the right. The distances L1 to L6 in FIG. 9*a* in an exemplary embodiment were 6700 mm, 6900 mm, 8500 mm, and 6800 mm, respectively, while the overall length of the fin tube was 10,000 mm (10 meters). FIG. 9*c* is an expanded cross-sectional view of a central part of one of the core tubes, illustrating the openings 49 on each side of tab 50.

Figure 10A:
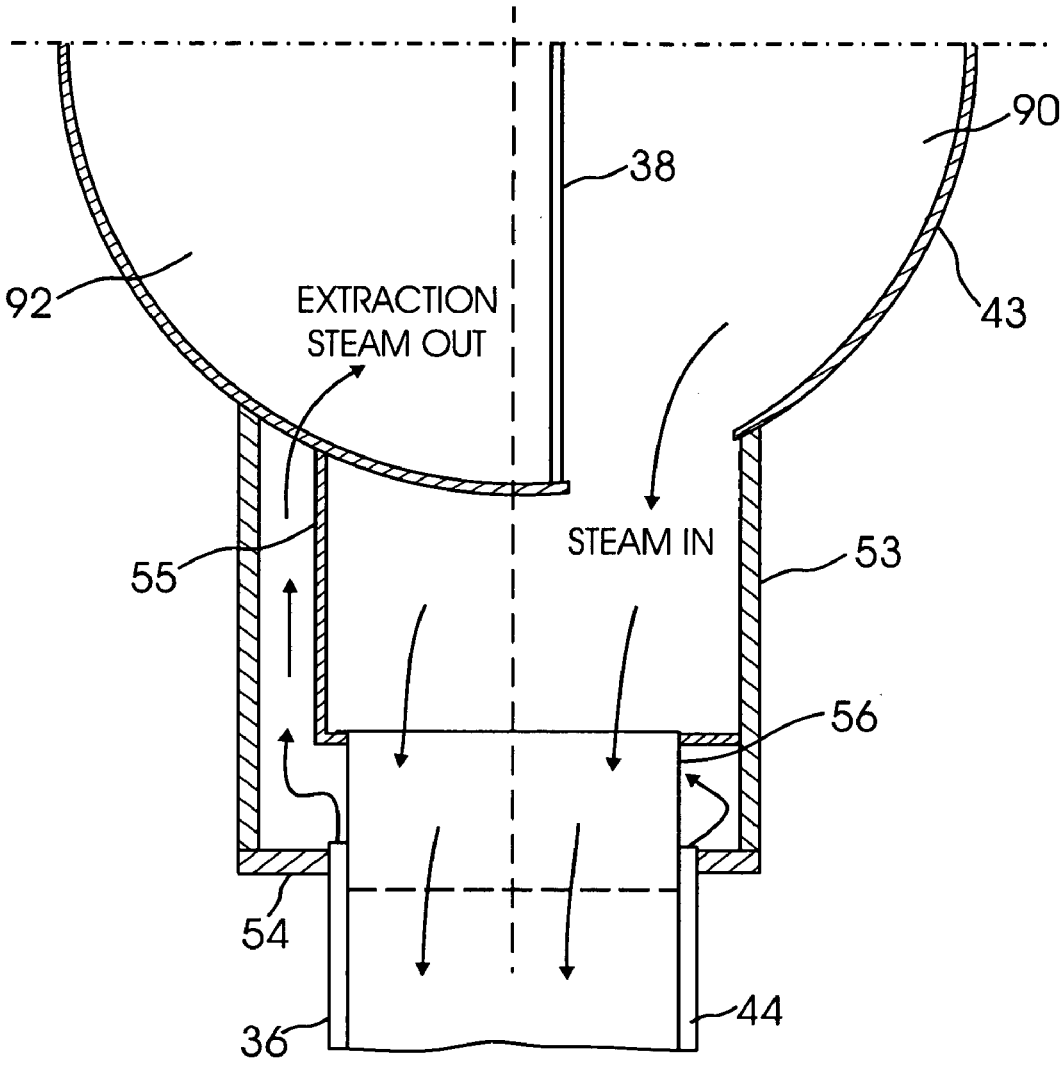
FIG. 10*a* is a cross-sectional view of the steam feed and extraction header and upper header box, including internal partitioning and upper tube sheet incorporated in each fin tube bundle.
Figure 10B:
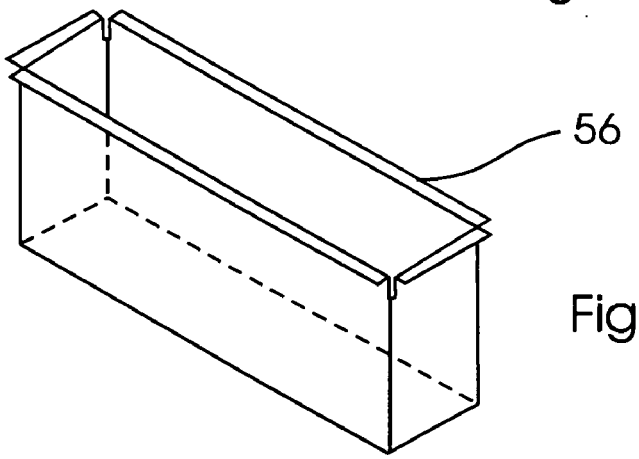
FIG. 10*b* is a perspective view of the core tube insert of FIG. 10*a;*

FIG. 10*a* shows a sectional view of the steam feed and extraction header at the top of the first stage fin tube bundles 51. As shown in FIG. 10*a*, a divider baffle 38 longitudinally partitions the steam feed and extraction header 43 into a feed side 90 and an extraction side 92. Steam present on the feed side 90 of this header enters through intermittent openings into a header box 53 that interconnects the header with the fin tube bundle tube sheet 54. The header box is further partitioned in the longitudinal direction by a right angle plate 55 that is connected to the header box and to the steam feed and extraction header. The right angle plate incorporates rectangular openings whose dimensions and locations match that of the main center flow channels 3 in the core tubes 36. A core tube insert 56 comprised of sheet metal is inserted into each of the openings in the right angle plate 55. The inserts, one of which is also shown in an isometric view in FIG. 10*b*, directs incoming steam into the center sections or flow channels 3 of the first stage core tubes.

As previously noted, approximately 5 to 10% of the total steam flow entering the first condensing stage tubes, along with any non-condensibles that are present, is extracted in the mid zone of the fin tubes. This steam enters the steam/air extraction channels 44 through the previously described oblong openings 49 incorporated in the core tube ribs 48. More specifically, the steam enters only the six openings (three per extraction channel) located above the two flow-blocking tabs 50. This steam flows upward in the steam/air extraction channels into the header box 53 and then enters the steam extraction side 92 of the steam feed and extraction header 43 through intermittent openings incorporated in the header. The extracted steam is ducted from there to the lower end of the second stage condenser.

In an exemplary embodiment of the invention, the dimensions of the tube openings 49 above tab 50 may vary, based on distance from the steam/air extraction header. For example, the uppermost opening may have dimensions of 3×9 mm, the central opening may have dimensions of 3×11 mm and the lowermost opening 49 (farthest from the suction) may have dimensions of 3×14 mm. These dimensions may be adjusted as desired for tuning off the extraction channels so as to provide substantially uniform extraction from the central portion of the main condensing channel 41.

Steam entering the first condensing stage from the bottom of the fin tubes flows up both the center section of the core tubes and also up both steam/air extraction channels. Two oblong openings 49 are incorporated in each of the steam/air extraction channel ribs 48 below the flow blocking tabs 50. These openings permit passage of steam between the center section of the core tube and the steam/air extraction channels, thus allowing steam pressure in the two passages to equalize.

Figure 11A:
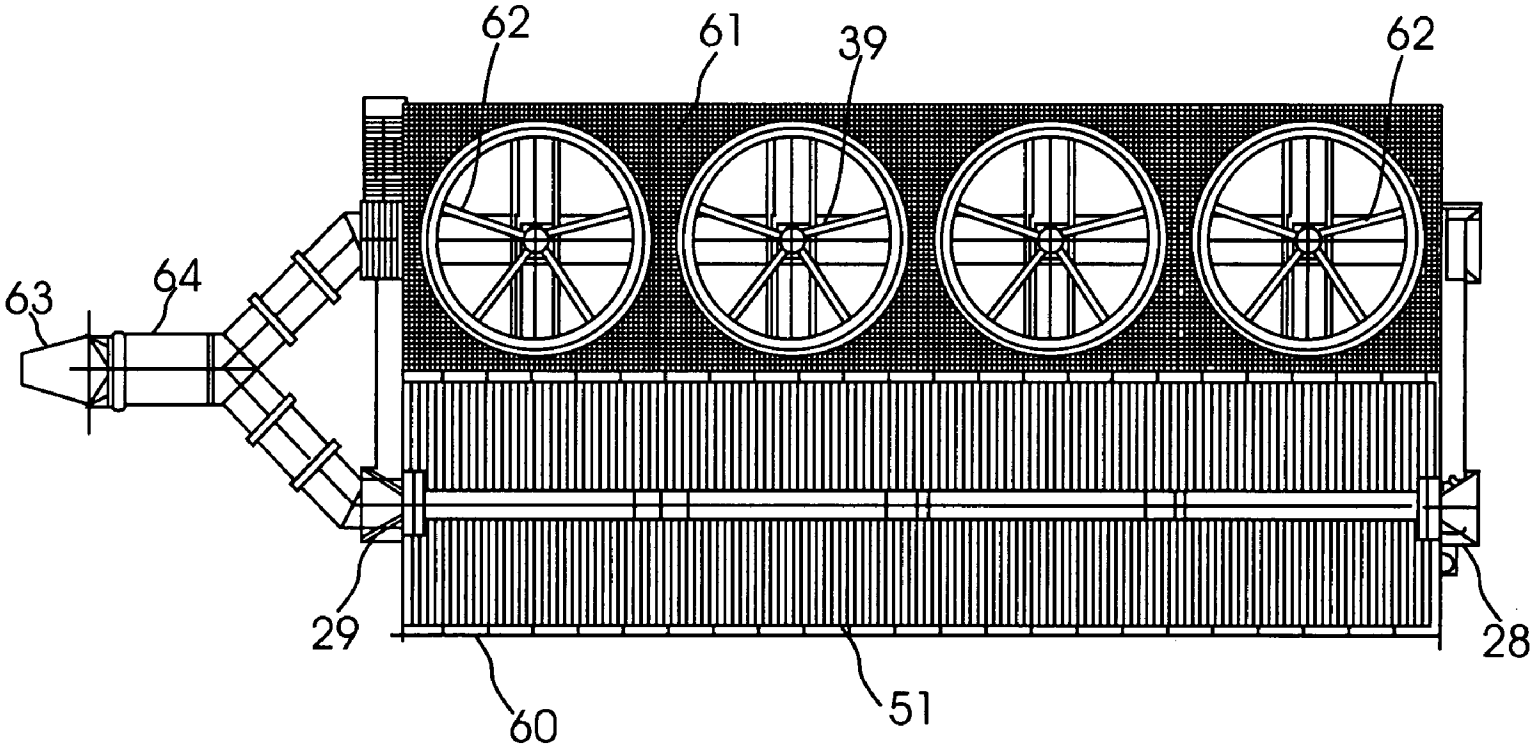
FIG. 11*a* is a plan view of an induced draft air-cooled condenser incorporating the twin feed K and D first stage and the D second stage of the present invention.

FIGS. 11*a, b* and *c* illustrate more details of a typical physical execution of an entire air cooled condenser system constructed to have K-D and D condenser stages as illustrated in FIG. 4, and to incorporate the features shown in FIGS. 5 through 10. An induced draft arrangement is shown in the example but it may also be executed as a forced draft arrangement.

FIG. 11*a* shows a plan view of the condenser 60 employing two condensing sections, each section comprising four cells 61 which are served by induced draft fans 62. The plan view shows one of the condenser sections viewed from above the fans and the second section viewed from above the first condensing stage 28 fin tube bundles 51. Steam exiting the steam turbine 63 enters the main steam duct 64 and then divides into two smaller ducts each feeding a lower steam distribution header 39 that extends the length of four cells beneath the lower ends of the fin tubes. The second stage condenser 29 is comprised of four sub-sections, two of which are incorporated in each end wall of the air-cooled condenser 60.

Figure 11B:
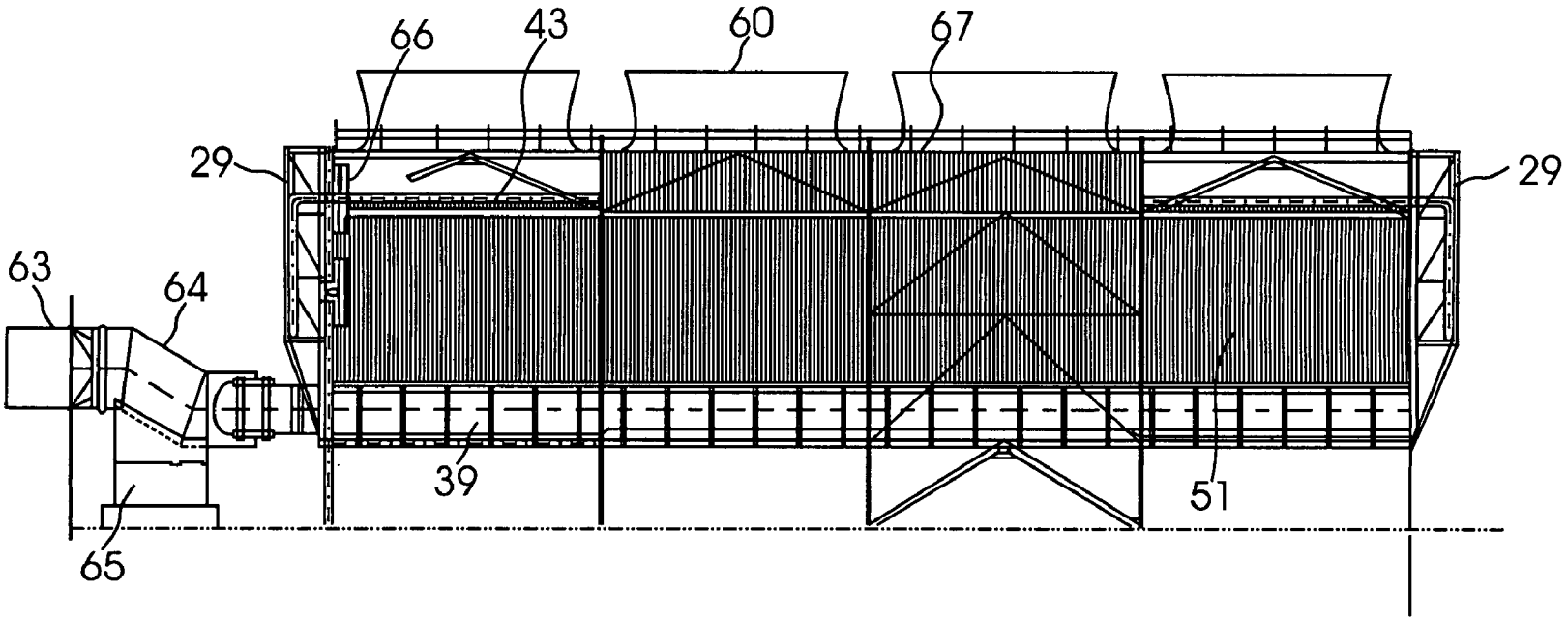
FIG. 11*b* is a longitudinal side view of the air-cooled condenser of FIG. 11*a;*

FIG. 11*b* shows a side view of the condenser 60. Steam to be condensed exits the turbine 63 and flows in the main steam duct 64 to the steam distribution headers 39. The steam distribution headers 39 are located below the first stage condenser fin tube bundles 51. As the steam is fed to the fin tube bundles 51, each header 39 is progressively reduced in diameter in a direction away from the main steam duct 64, as shown in FIG. 11*b*, so that its lower surface steps downwardly towards the turbine 63. The condensate collection tank 65 is located near the steam turbine and is directly connected to a lower portion of the main steam duct 64. The second stage condenser 29 sub-sections are also located above the steam distribution duct and are arranged for induced draft as shown in FIG. 11*b*. Each sub-section is served by two fans 66 that draw cooling air through the fin tubes 38 of the second stage condensers 29 and discharge the warm air into the plenum space located downstream of the first stage fin tube bundles 51. Casing 67 located in the upper area of the air-cooled condenser 60 encloses the plenum space. All condensate formed in the first and second stage condensers drains by gravity into the steam distribution ducts 39 and from there to the condensate tank 65.

Figure 11C:
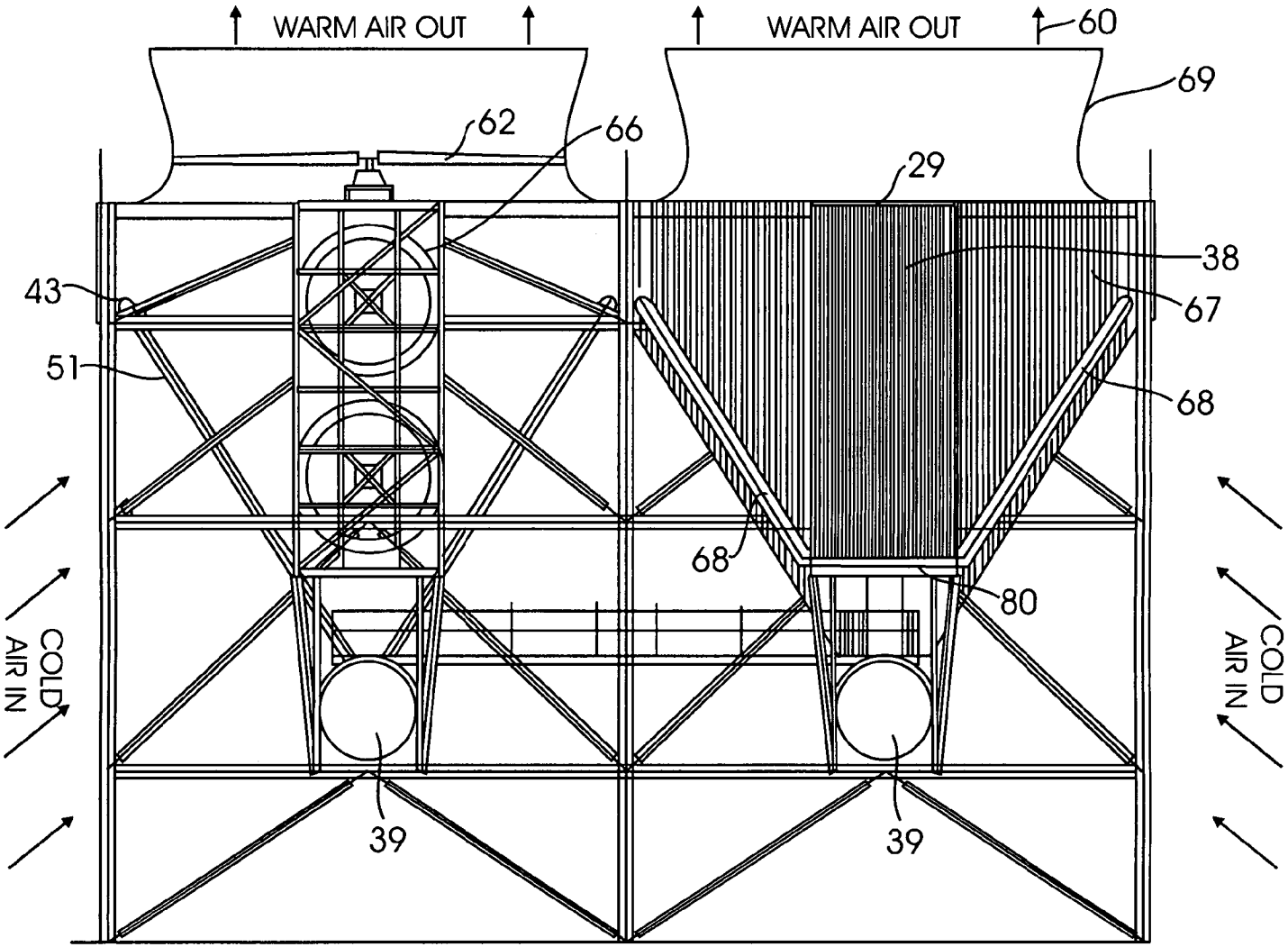
FIG. 11*c* is an end view of the condenser of FIGS. 11*a* and 11*b;*

FIG. 11*c* shows an end view of the induced draft air-cooled condenser 60 with the first condensing stage fin tube bundles 51 arranged in a double V configuration and the second stage condenser 29 fin tubes 38 arranged vertically. The two steam distribution headers 39 feeding the first stage fin tube bundles 51 from below are shown in cross-section as are the steam feed and extraction headers 43 located at the top of the fin tube bundles. Steam and associated non-condensibles extracted from the first stage fin tube bundles are routed in the steam feed and extraction headers 43 and associated transfer pipes or auxiliary ducts 68 to the bottom or header 80 of both of the second stage condensers 29 as seen in FIGS. 11*b* and 11*c*.

The main induced draft fans 62 draw air through the fin tube bundles 51 where the air is heated and then discharge the air vertically upwards to atmosphere through fan stacks 69. Similarly the second stage condenser fans 66 draw cold air through second stage fin tubes 38 and discharge the warmed air into the plenum area above the first stage fin tube bundles 51. The warm air streams exiting the two condenser stages mix in the upper plenum on their way to the main fans 62. During non-freezing ambient conditions the second stage fans operate at part speed with the second stage condenser 29 air moving function being accomplished primarily by the large main fans 62. During colder ambient conditions, particularly when freezing conditions exist, the speed of the main fans is reduced to reduce overall condensing capacity and to control turbine backpressure and the speed of the second stage fans 66 is increased to increase the amount of steam and non-condensibles extracted from the first stage condenser 28. This results in effective freeze protection of the entire condensing system. The second stage fans 66 are preferably driven by variable frequency drives to allow airflow modulation over the second stage condensers 29 over a wide range of flows.

All steam ducting, tubing and piping in an air-cooled condenser operates at high vacuums during normal operation with atmospheric pressure applied to the exterior surfaces of these components. They are therefore classified as externally pressurized vessels. The externally applied atmospheric pressure applied to core tubes 25 in the prior art system of FIG. 3 causes each core tube to compress by a small amount. A fin tube bundle can be comprised of a multitude of core tubes interconnected by fins 26 as also shown in FIG. 3. In such a fin tube bundle, the cumulative deflection of all the core tubes creates a significant gap between adjacent fin tube bundles. This allows cold air to bypass the bundles causing a reduction in heat transfer performance. In order to stop the bypass of air, special seals have to be installed between fin tube bundles during construction, resulting in added costs. The design of the core tubes 36 of the present invention inherently prevents the above noted deflections from occurring by virtue of the fact that each core tube incorporates two integral ribs 48 whose primary function is to create the two external steam/air extraction channels 44. In addition to this function the ribs also buttress the core tubes against the external pressure applied by atmosphere, thereby virtually eliminating the vacuum induced deflections. There is, therefore, no need for special air seals, reducing expense and complexity of the installation.

All condensate formed in the fin tube bundles exits the fin tube bundles with a minimum of sub-cooling since it drains in a direction counter to the incoming steam. After exiting the fin tube bundles the condensate continues to flow in a direction counter to incoming steam as it drains via the distribution ducting and main steam duct back to the condensate tank. As can be seen in FIG. 11*b*, the main steam duct 39 is inclined in a generally downward direction, such that condensate flows under gravity to the condensate tank, against the incoming steam flow. The result is a virtual absence of sub-cooling with minimal dissolved oxygen in the condensate, eliminating the need for a separate and expensive de-aerator In the first embodiment described above, the core tube employed as part of the fin tube has a narrow rectangular shape with half-round ends. (See FIGS. 5 to 7). The fins are attached to the two parallel sides of the core tube. The core tube is comprised of two formed sections, each incorporating an integral rib. When assembled the two sections comprise a core tube that has three flow channels. The central channel is in the mid section of the tube. The two remaining channels are much smaller, are located on the leading and trailing edges of the core tube and are un-finned. The ribs prevent the core tube from deflecting due to vacuum induced forces and thus maintain stable fin tube geometry. The ribs are perforated by a series of oblong openings along their length to allow flow between the main center channel and the outer channels. The channels 44 on the leading and trailing edge of the core tube comprise extraction channels which are open on both ends and have a flow-blocking tab incorporated approximately ⅓ of the distance up the channel. Steam flows up the portion of the channel below the flow-blocking tab, entering the main center channel through the oblong openings in the rib. The portion of the channel above the flow-blocking tab serves as a steam and non-condensibles conduit to the extraction side of the steam feed and extraction header, which ultimately connects to the second stage condenser.

Figure 12:
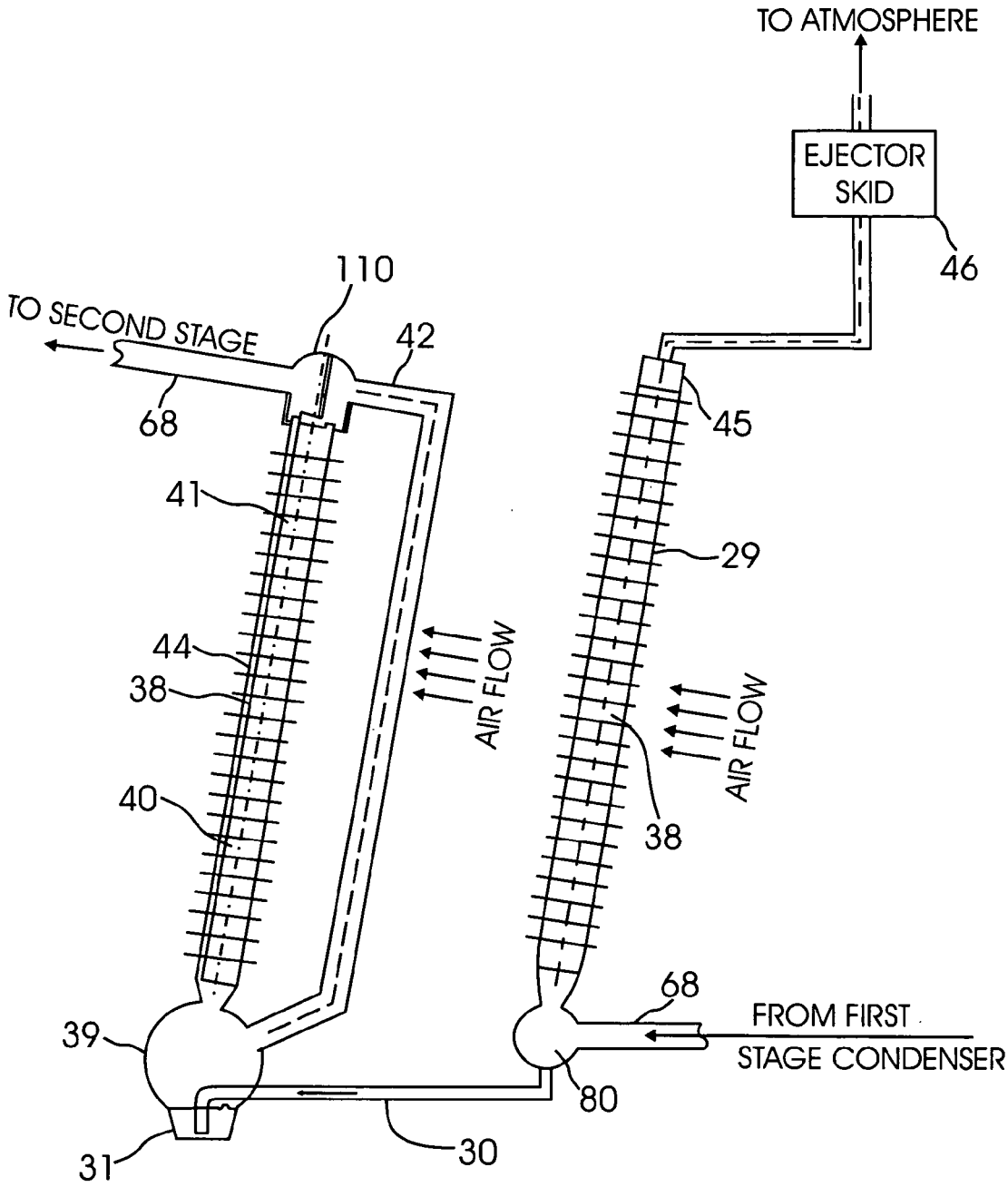
FIG. 12 is a simplified schematic a two-stage condensing system according to a second embodiment of the invention, employing a combination K and D section in the first stage and a D section in the second stage.

FIG. 12 is a schematic representation of a two-stage condensing system according to a second embodiment of the invention. This embodiment is the same as the first embodiment except that only one steam and non-condensibles extraction channel 44 is employed per fin tube, and a modified steam feed and extraction header 110 is provided at the upper ends of the first stage fin tubes, and like reference numbers are used for like parts as appropriate. As shown in FIG. 12, the extraction channel 44 is located on the trailing edge of the core tube, facing away from the cooling air flow, where the air is considerably warmer than on the leading edge.

Figures 13A, 13B, 13C, 13D:
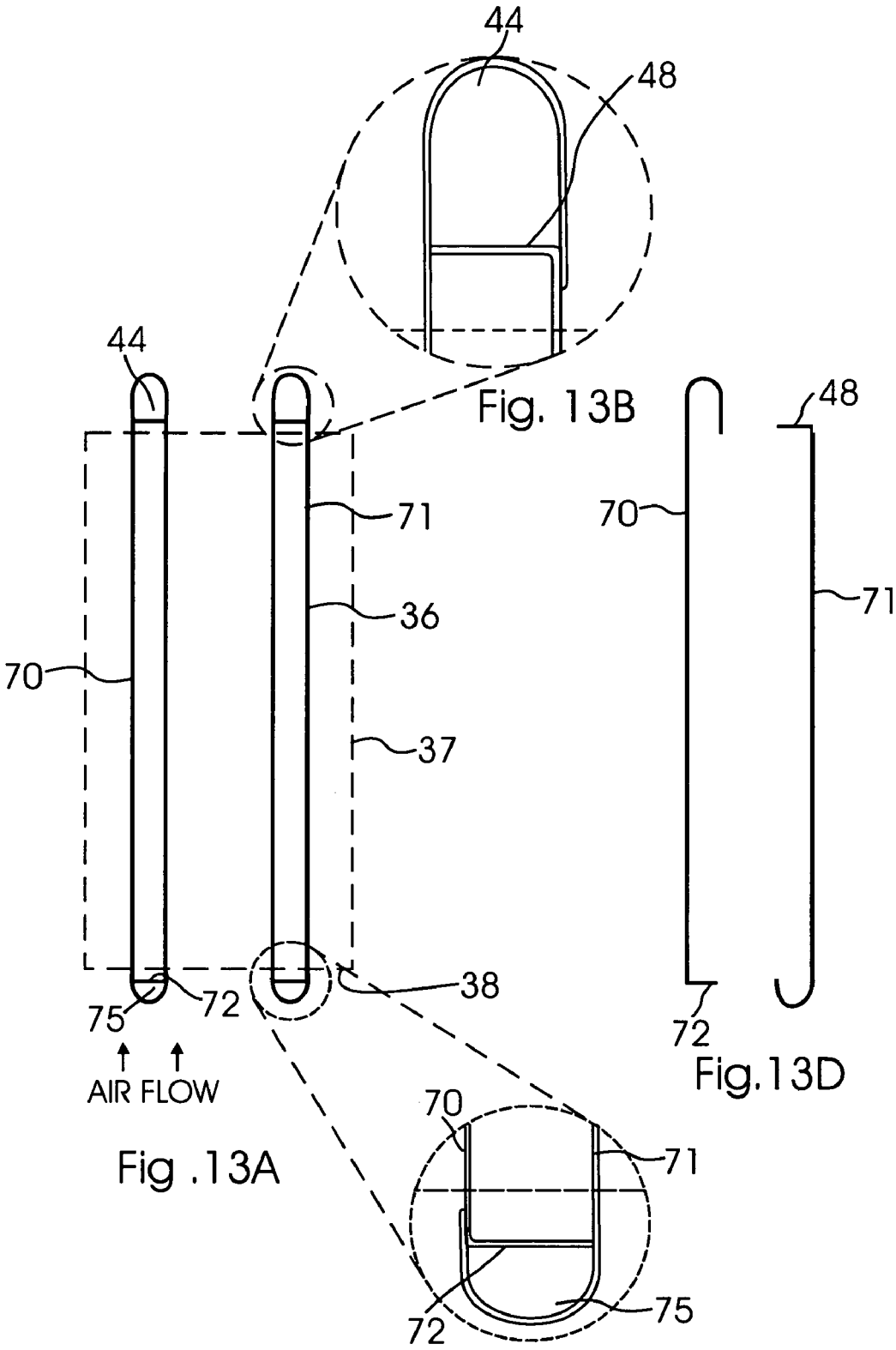
FIG. 13*a* is a cross-section of the fin tubes employed in the second embodiment.
FIG. 13*b* is a detail of the core tube portion of the fin tube showing the rear partitioning rib.
FIG. 13*c* is a detail of the core tube portion of the fin tube showing the front rib.
FIG. 13*d* is a detail of the core tube portion of the fin tube showing the two sections comprising the core tube.

FIG. 13*a* is a cross-section of the fin tube 38 showing that three flow channels are incorporated in the core tube 36. FIG. 13*b* is a detail of the steam/air extraction channel 44 located on the trailing edge of the core tube. The exterior surfaces of this channel are un-finned and its cross-sectional area can be adjusted depending on the amount of steam/air extraction that is required. In the illustrated embodiment, the single extraction channel 44 is approximately double the size of the equivalent channel of the first embodiment, although the size may be adjusted as necessary.

FIG. 13*c* is a detail of the small lower channel 75 located on the leading edge of the core tube which is also un-finned. Steam enters the lower or leading edge channel 75 from both ends of the fin tube and almost all condensate formed in the core tube drains down this channel, as described in more detail below. FIG. 13*d* shows the two sections 70 and 71 that form the core tube. Section 70 incorporates an integral rib 72 at one end, and section 71 an integral rib 48 at the opposite end. Each section has a rounded end portion at the opposite end, with the rounded end portion of section 71 being shorter than that of section 70. These sections are welded together as shown on FIGS. 13*a*, 13*b* and 13*c*. The integral stiffening ribs 48, 72, in addition to creating the internal flow channels, serve a second important function, which is to buttress the core tube against vacuum-induced forces. Thus they reduce or eliminate tube deflections, maintaining stable fin tube geometry. It can be seen in FIG. 13*a* that the fin tubes of this embodiment have a flow channel 44 on the trailing edge that is larger than flow channel 75 on the leading edge of the fin tube.

Figure 14:
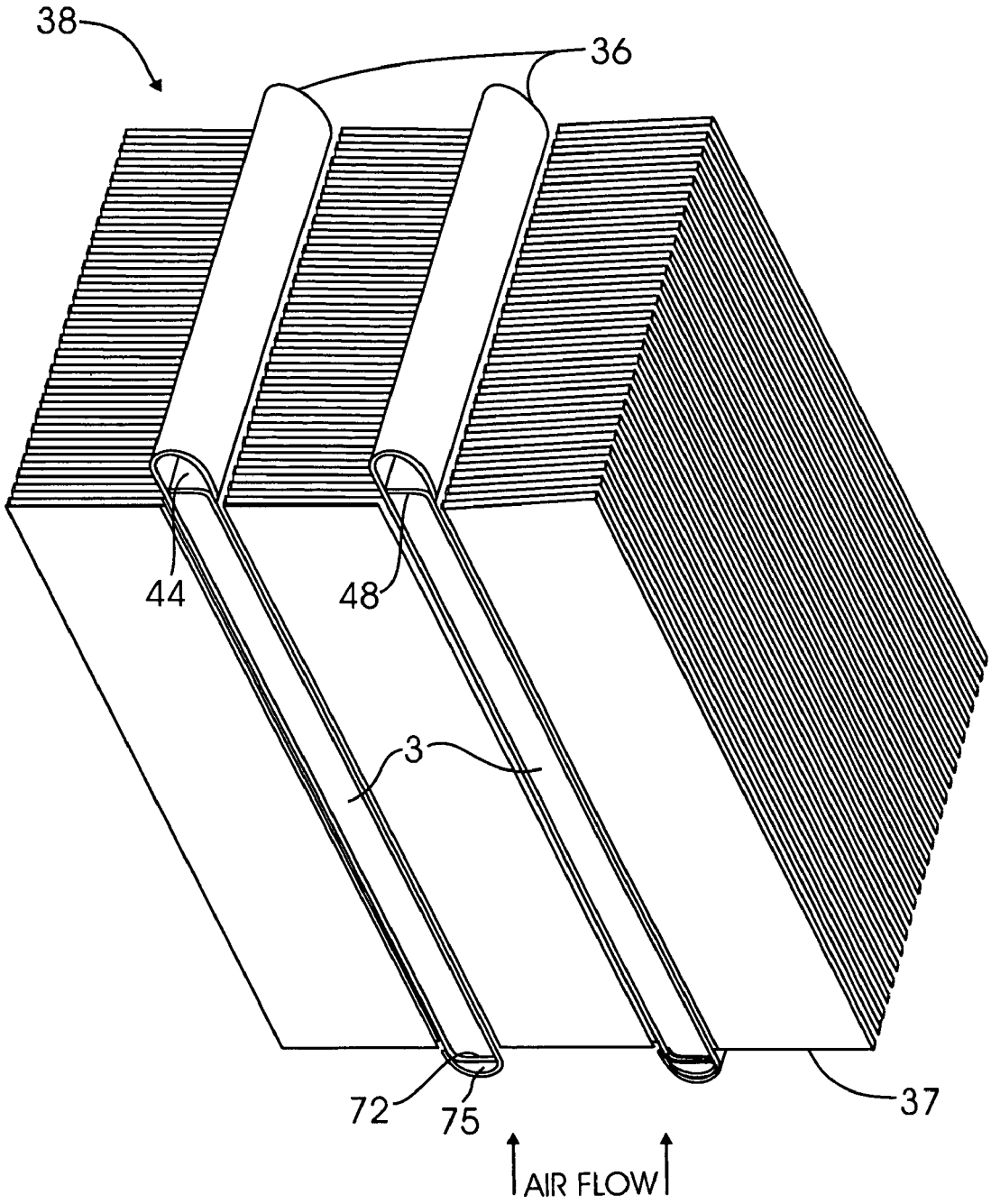
FIG. 14 is an isometric view of the fin tube of the second embodiment.

FIG. 14 shows an isometric view of the fin tube with the steam/air extraction channel 44 shown on the upper trailing edge of the core tube 36. Placing the channel 44 on the trailing edge inherently freeze protects the small amount of steam and non-condensibles being extracted, as it is located in the warm air stream exiting the fin tubes, in addition to being un-finned.

Figure 15A:
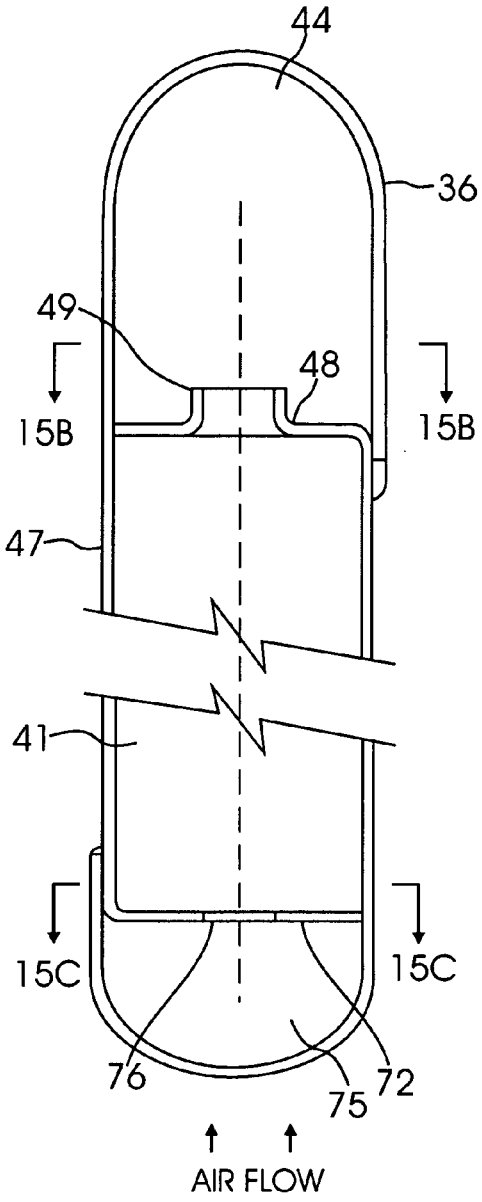
FIG. 15*a* is a cross-section of the core tube of the second embodiment.
Figure 15B:
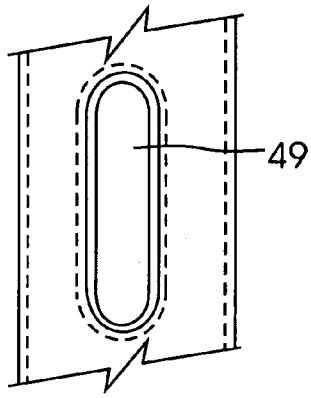
FIG. 15*b* is an auxiliary section view on the lines 15*b*—15*b* of FIG. 15*a*, showing the oblong opening in the upper partitioning rib of FIG. 15*a;*
Figure 15C:
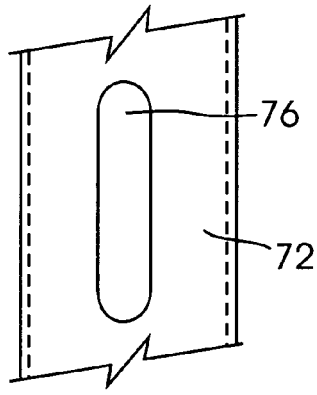
FIG. 15*c* is an auxiliary section view on the lines 15*c*—15*c* of FIG. 15*a*, showing the oblong openings in the lower partitioning rib.
Figures 15D, 15E:
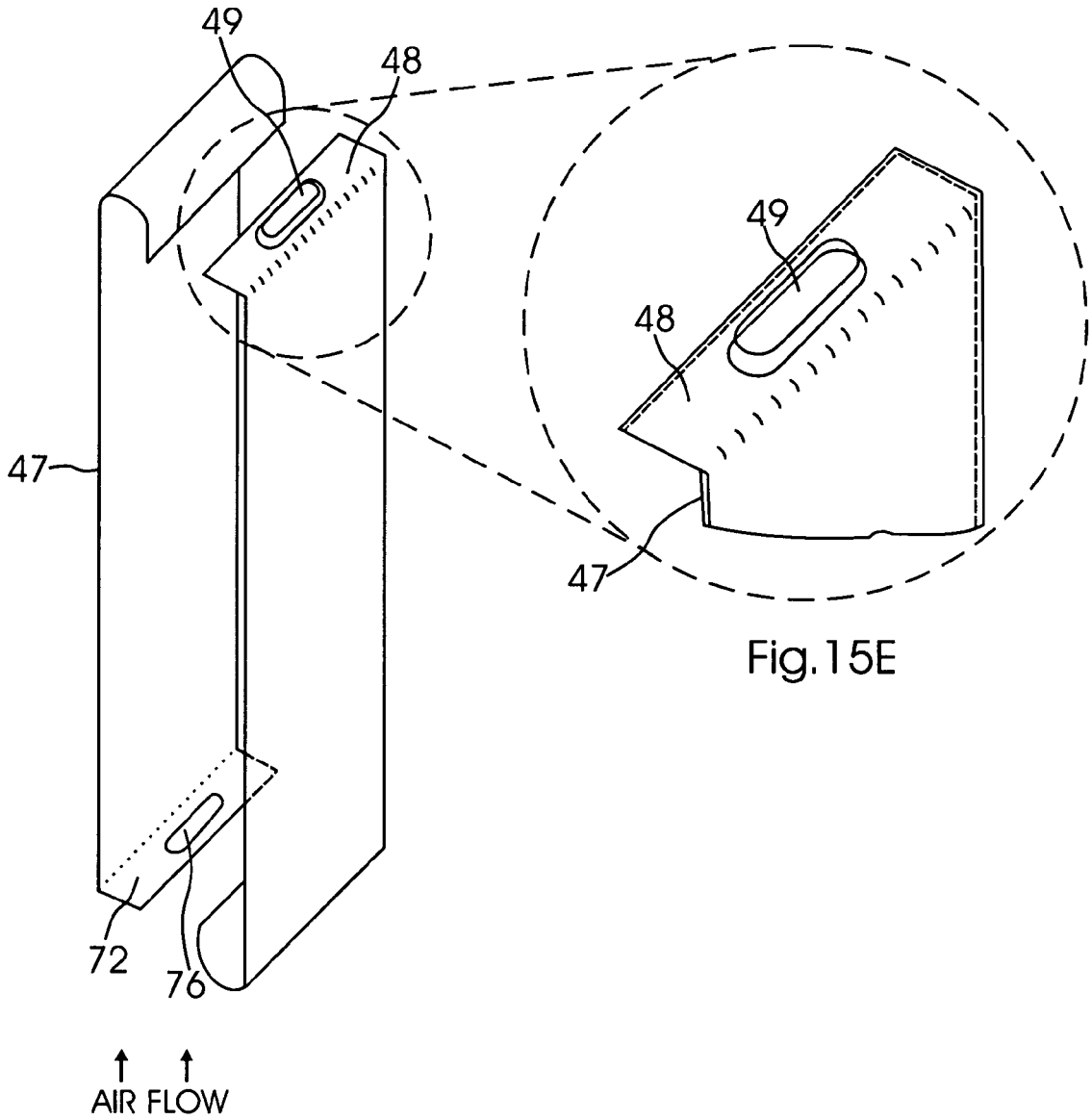
FIG. 15*d* is an isometric view of part of the two core tube sections forming the core tube.
FIG. 15*e* is a detail of part of FIG. 15*d* showing one of the openings.

FIG. 15*a* is a cross-section of the core tube 36 showing one of the oblong openings 49 incorporated in the upper ribs 48 and one of the oblong openings 76 in the lower ribs 72. The openings 49 in the upper rib are contoured to form a dam around each opening, as shown in FIGS. 15*a* and 15*b*, and as in the first embodiment. This allows draining condensate forming in the upper steam/air extraction channel to bypass the openings without interfering with the inflow of the steam/air mixture. The openings 76 in the lower rib 72 are flat, not contoured, as shown in FIGS. 15*a* and 15*c*. This means that condensate forming in the main center channel 41 can flow readily through the openings 76 and drain down the lower channel to the main distribution header 39 and drain pot 31. FIG. 15*d* is an isometric view of part of the sections 70 and 71 prior to welding, showing one each of the oblong openings 49 and 76 incorporated in the upper and lower ribs 48, 72 respectively. FIG. 15*e* is a detail of the upper opening 49.

Figure 16A:
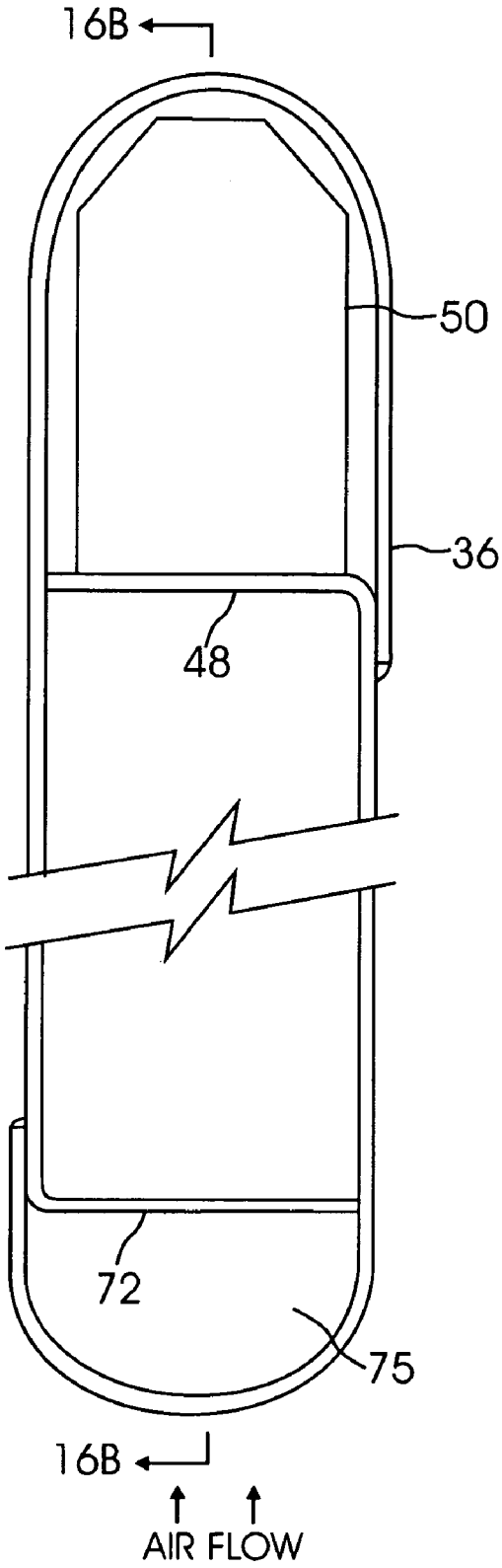
FIG. 16*a* is a cross-sectional view of the core tube illustrating the flow-blocking tab incorporated in the rear channel of the core tube.
Figure 16B:
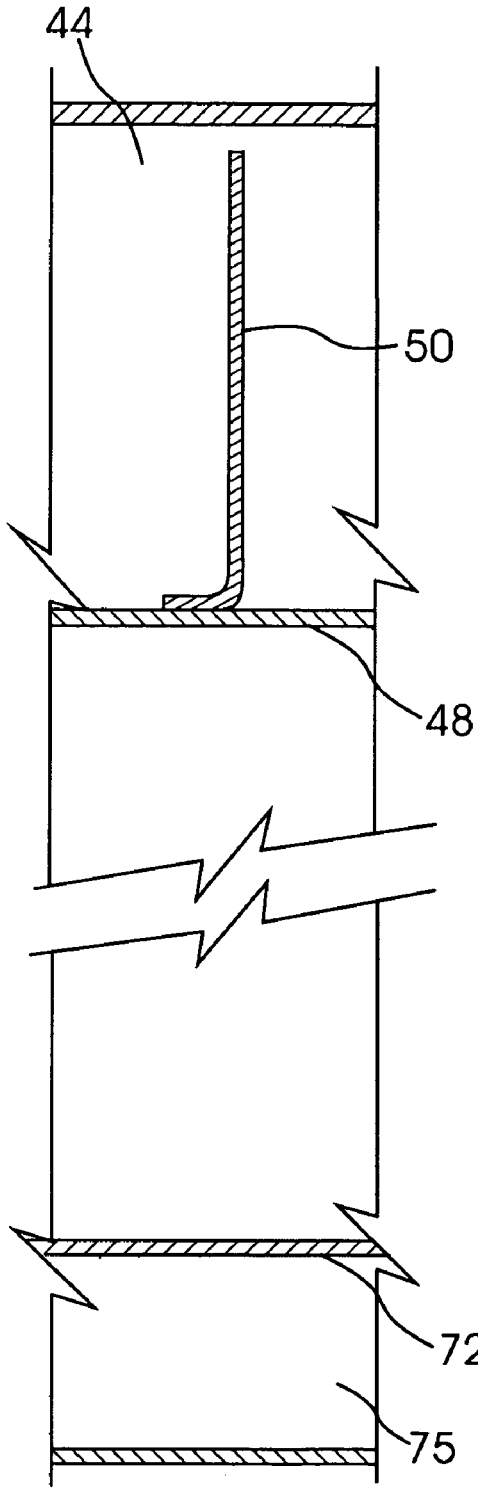
FIG. 16*b* is a cross-section on the lines 16*b*—16*b* of FIG. 16*a;*

FIGS. 16*a* and 16*b* show the flow blocking tab 50 located in the upper steam/air extraction channel 44 at the trailing end of the fin tube. The tab is welded to the upper rib 48 and is shaped to follow the contours of the upper channel with a small amount of clearance between the tab and the tube. This effectively blocks steam flow at the tab location while allowing condensate to drain past the tab 50 in the same way as the tabs of the first embodiment. During normal operation, steam and non-condensibles are extracted from the main center channel via multiple openings 49 into the section of channel 44 that is above the flow-blocking tab 50.

Figure 17A:
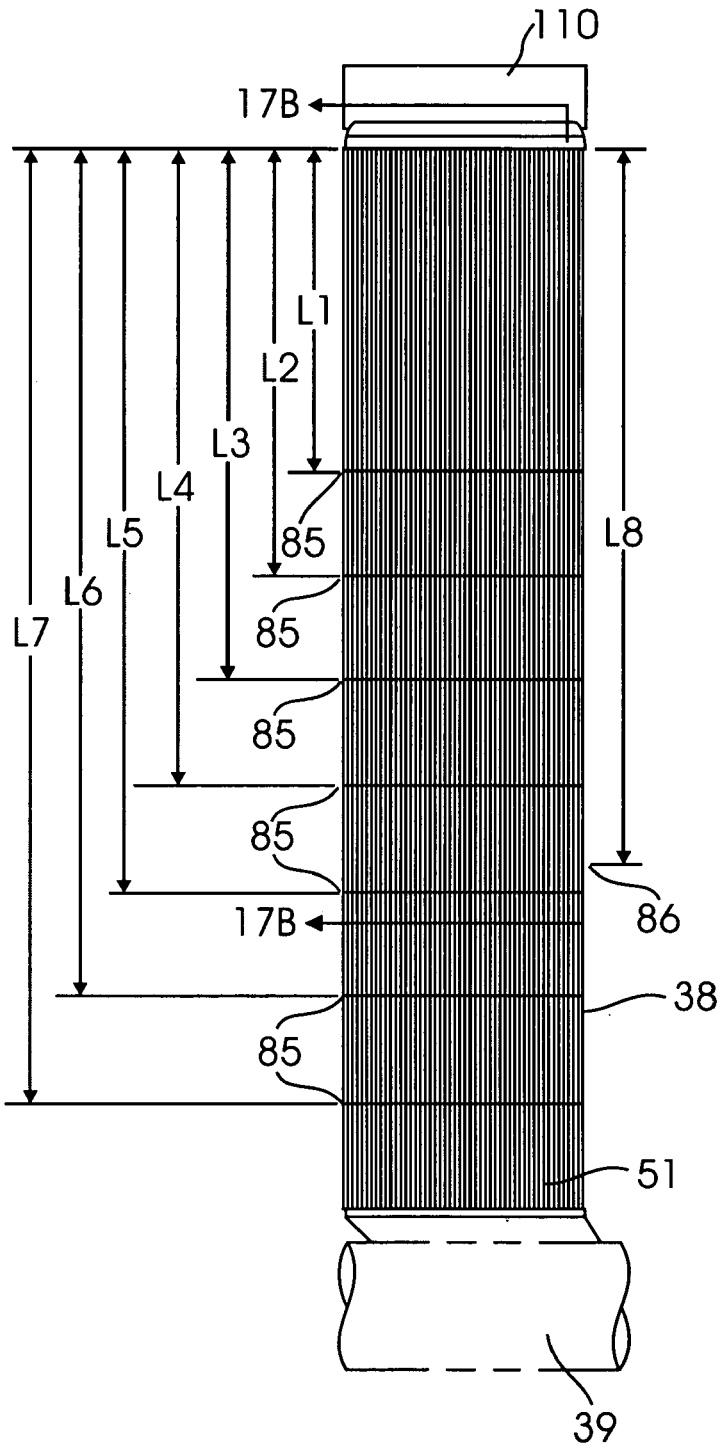
FIG. 17*a* is a front view of an entire fin tube bundle using the fin tubes of FIGS. 12 to 16 and showing the locations of the oblong openings and also the location of the closure tabs incorporated in the extraction flow.
Figure 17B:
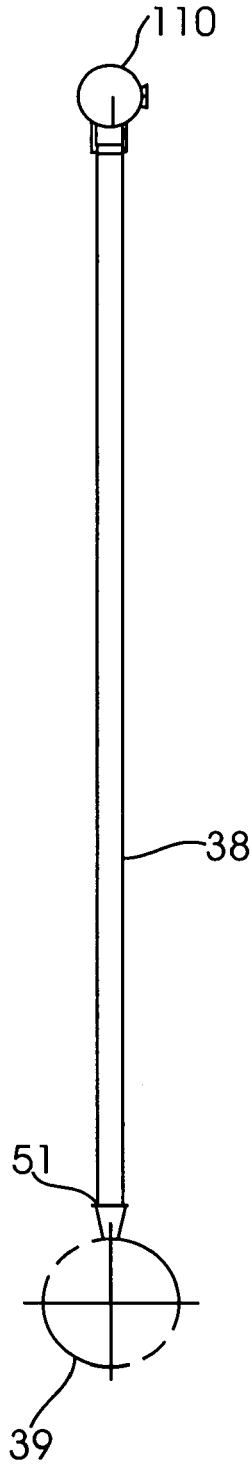
FIG. 17*b* is a side view of the fin tube bundle of FIG. 17*a;*

FIGS. 17*a* and 17*b* are front and side views, respectively, of a typical first condensing stage fin tube bundle 51 in accordance with the second embodiment of the invention, illustrating the locations of the openings 49 and 76. Seven openings 49 and seven openings 72 are incorporated in ribs 48, 72 respectively, at locations 85 shown in FIG. 17*a*. The location 86 of the flow-blocking tab 50 incorporated in each core tube is also shown in FIG. 17. The distances L1 to L8 in FIG. 17*a* in an exemplary embodiment were 3000 mm, 4000 mm, 5000 mm, 9000 mm, and 6800 mm, respectively. It can be seen that four openings 49 are provided above tab 50 in extraction channel 44.

Figure 18A:
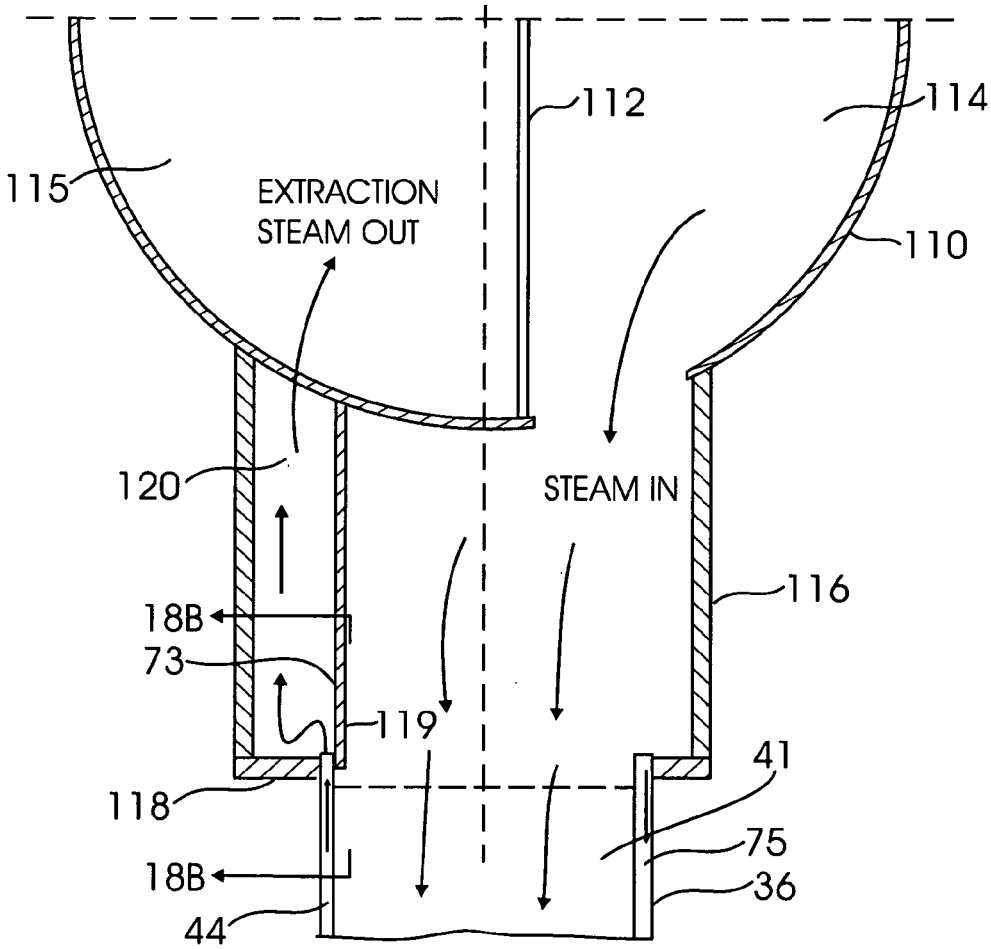
FIG. 18*a* is a cross-sectional view of the steam feed and extraction header, upper header box including internal partitioning and upper tube sheet incorporated in each fin tube bundle.
Figure 18B:
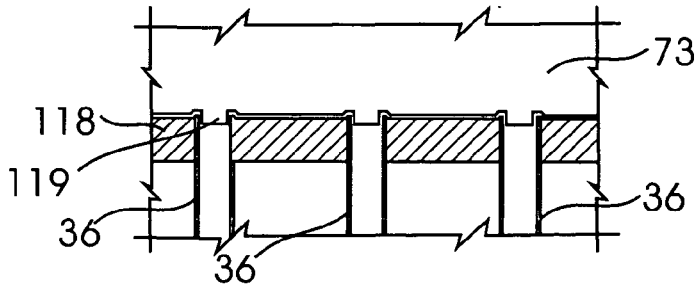
FIG. 18*b* is a sectional view on the lines 18*b*—18*b* of FIG. 18*a;*

FIG. 18*a* shows a sectional view of the steam feed and extraction header 110 incorporated at the top of the first stage fin tube bundles 51 of FIG. 17. As shown in FIG. 18*a* a divider baffle 112 longitudinally partitions the steam feed and extraction header 110 into steam feed side 114 and an extraction side 115. The connection between header 110 and the different parts of the core tube is simpler in this case because only one side channel 44 has to be connected to the extraction side 115 of the header. The other side channel 75 is connected to the steam feed side 114 of the header. Steam present on the feed side 114 of this header enters through intermittent openings into a header box 116 that interconnects the header with the fin tube bundle tube sheet 118. The header box 116 is further partitioned in the longitudinal direction by a plate 73 that extends between the steam feed and extraction header and the tube sheet 118 below. The bottom edge of the plate is uniquely contoured as shown in FIGS. 18*a* and 18*b* with protrusions or castellations 119 to create a seal between the steam feed and extraction sides of the header box. Steam flows from the feed side 114 of the header through the header box and into the main channels 41 and leading edge channel 75 of each core tube.

As previously noted, approximately 5 to 10% of the total steam flow entering each first condensing stage fin tube, along with any non-condensibles present, is extracted out of the mid zone of the fin tube. This steam enters the steam/air extraction channel 44 through the previously described oblong openings 49 incorporated in the core tube ribs 48.

More specifically, the steam enters only through the openings located above the flow-blocking tab 50. This steam flows upward in the steam/air extraction channel 44 into the partitioned section 120 of header box 116 and then enters the steam extraction side 115 of the steam feed and extraction header 110 through intermittent openings incorporated in the header. The extracted steam is ducted from there to the second stage condenser 29 in exactly the same way as the first embodiment.

Figure 19:
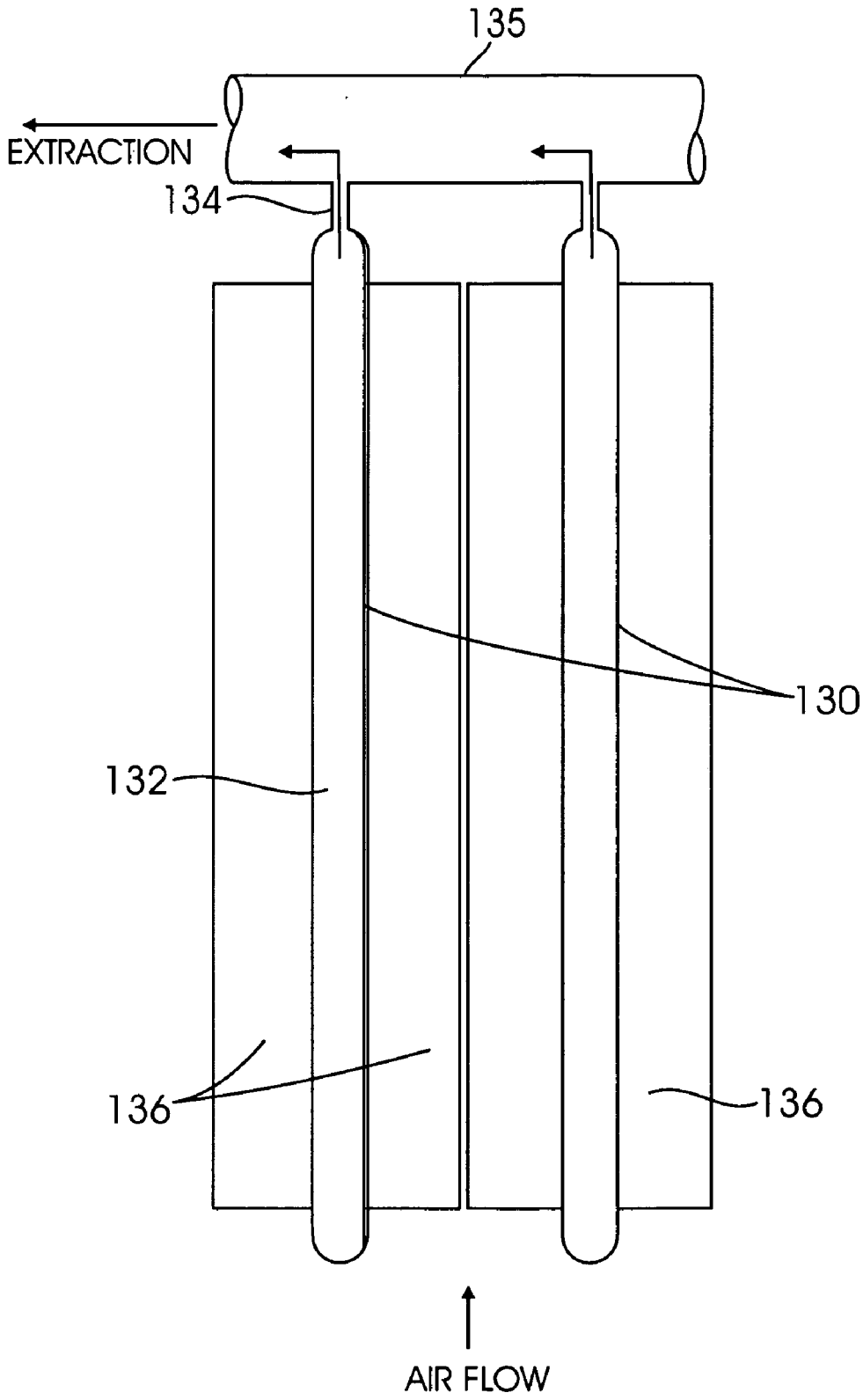
FIG. 19 is a sectional view of two core tubes of a modified fin tube assembly an the alternative extraction arrangement.
Figure 20A:
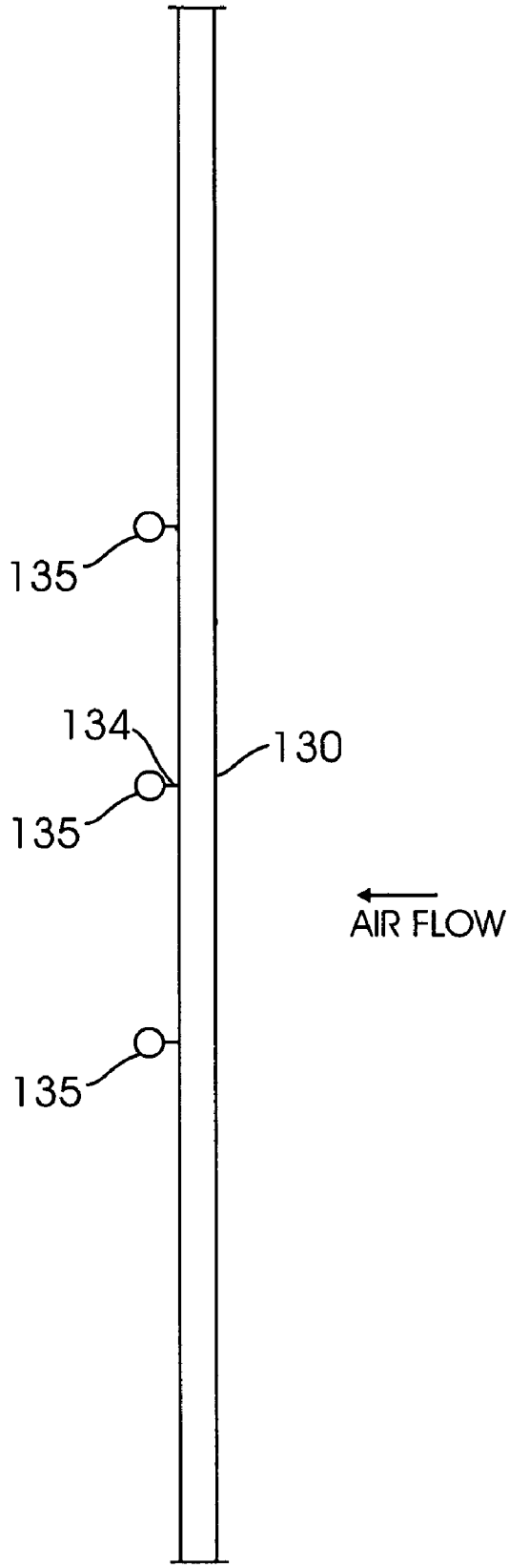
FIG. 20*a* is a vertical section through one of the core tubes of FIG. 19, illustrating the location of the extraction pipe.
Figure 20B:
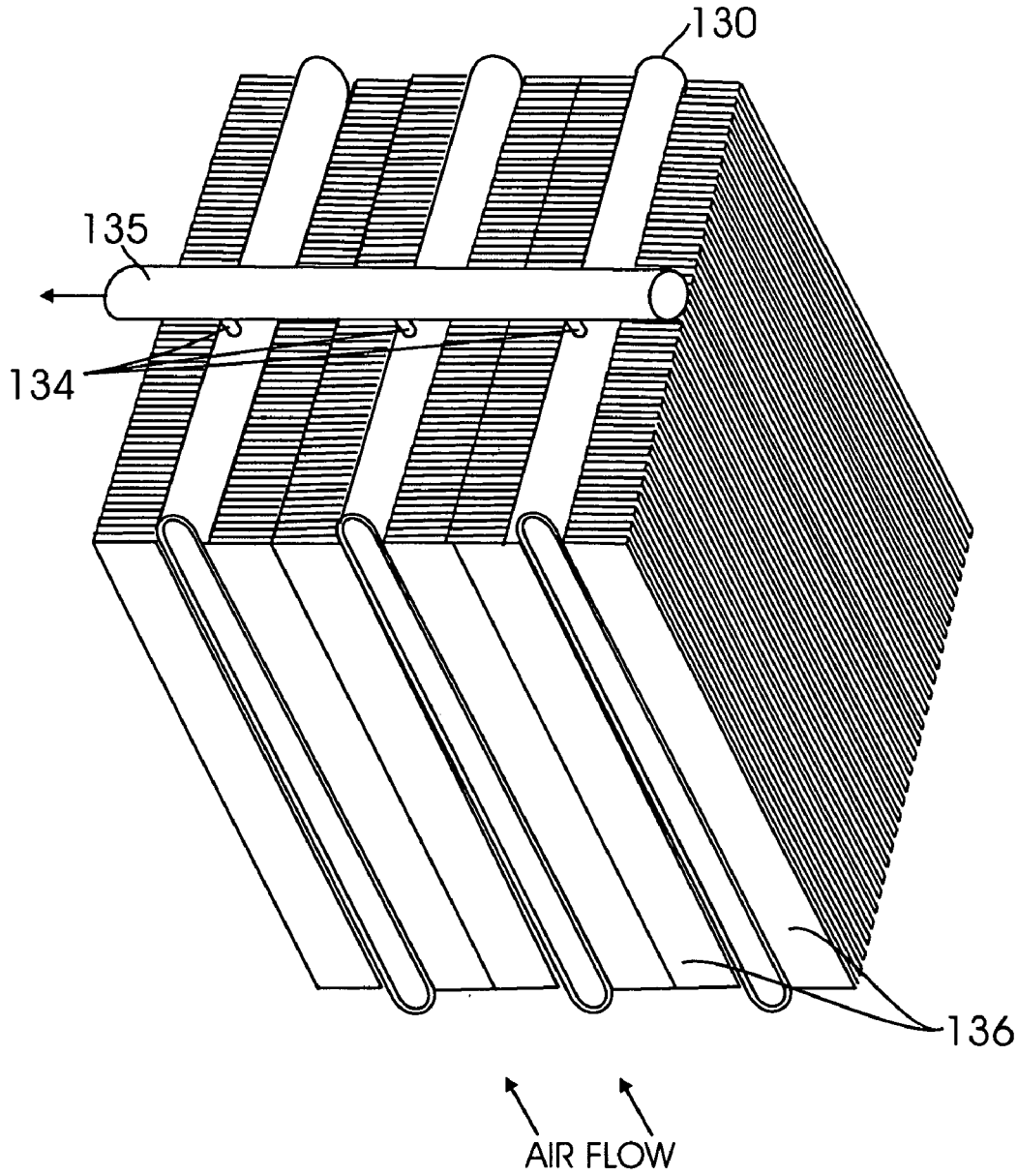
FIG. 20*b* is a perspective view of the fin tube assembly of FIGS. 19 and 20*a*.

FIGS. 19, 20*a* and 20*b* illustrate another embodiment of the invention in which one or more external ports 134 are connected to the trailing end of each core tube 130 in the first stage condenser in the central one third of the tube. In the previous embodiments, steam and non-condensibles are collected in the combination feed and extraction header at the upper end of each core tube. The extraction ports of this embodiment are connected by extraction pipes 135 to the second stage, D condenser, which will be identical to the second stage condenser of the previous embodiments. The internal ribs in the core tubes of the first stage condenser may be eliminated, with each core tube 130 being completely hollow and having a single internal condensing chamber 132. Alternatively, internal ribs may still be provided in this embodiment for strengthening purposes with holes or slots drilled for communicating steam and non-condensibles to the extraction ports.

As in the previous embodiments, steam and non-condensibles remaining in the central portion of the core tube will be drawn out via the ports 134 due to the suction action developed in the second stage, D-condenser 29. By placing the extraction ports on the trailing edge of each core tube, where the air will be warmer, the risk of freeze-up of the extraction ports is substantially reduced.

As illustrated in FIG. 20*b*, each core tube 130 has a series of parallel fins 136 extending outwardly from its opposite flat faces, and the fins of adjacent fin tubes may be welded together as indicated in FIG. 20*b*, or may be integral ribs as in FIG. 6. Alternatively, sets of single, separate fin tubes each with their own set of fins may be used in the condenser system.

The air-cooled condensing system of each of the above embodiments has a plurality of condenser fin tube bundles in which the steam is condensed. Steam is condensed in a two-stage process where the steam is fed by a steam distribution duct to both ends of the first stage fin tube bundles, establishing both counterflow (D) and parallel flow (K) condensing modes. This sweeps both steam and any non-condensibles that are present into the center region of the first stage fin tube bundles. A small amount of this mixture is continually extracted from the center region of these fin tubes via one or two extraction channels that are integrally incorporated in the first stage fin tubes, or via extraction ports at the trailing ends of the channels. The extracted mixture of steam and non-condensibles is collected in a header connected to the upper end of the first stage fin tubes and the mixture is ducted from there to a second stage condenser where it enters the fin tubes from the bottom. Steam flows upward in the second stage fin tubes in a counterflow (D) condensing mode sweeping the non-condensibles into the upper regions of the fin tubes for removal by conventional air ejection equipment. All condensate formed in the first and second stage fin tubes drains by gravity into the steam distribution duct and from there via the main steam duct into a condensate collection tank. In the second embodiment of the invention, steam and non-condensibles are extracted exclusively out of channels that are located on the trailing edge of the core tubes. The second embodiment is otherwise the same as the first embodiment.

In the above embodiments, a short and direct steam path is provided from the turbine to the fin tube bundles, thereby reducing steam pressure drops and increasing thermal performance. The primary steam delivery to the individual first stage fin tube bundle is via a lower steam distribution header. Delivery to the upper end of the first stage fin tube bundle is via steam transfer pipes fed by the lower steam distribution header. The two-stage condensing process has a first stage which is twin-fed and a second-stage condenser which operates as a dephlegmator. Each condensing stage is served by its own dedicated air moving system, allowing modification of fan speeds based on ambient air temperatures in each embodiment. Steam and non-condensibles are extracted from each first-stage fin tube via channels integrally incorporated in the core tube.

In the second and third embodiments of the invention, a single extraction channel or plural extraction ports are located in the upper and trailing edge of the core tube. This places the channel in the warm air exiting the fin tube, thereby maximizing freeze protection and avoiding flow interference with draining condensate. In the first two embodiments, location of the extraction channels in unfinned sections of the core tube will minimize heat transfer, reducing condensation.

The first two embodiments have a combination steam feed and extraction header incorporated at the upper end of the first stage fin tube bundles, the header having a divider baffle separating it into feed and extraction sides or passages. A header box with unique partitioning means connects the feed side of the header to the main part of each core tube and the extraction side to the extraction channel or channels.

The core tubes of the first and second embodiments and, optionally, also the third embodiment, are formed from two sections, each incorporating an integral stiffening rib. The ribs form two additional flow channels in each core tube. They also buttress the tube against vacuum induced forces thereby maintaining stable fin tube geometry during operation. Oblong openings incorporated in the stiffening ribs permit flow between the main center section of the core tube and the side channels. One flow-blocking tab is incorporated in each extraction channel. The tab is shaped to block steam flow but permit condensate drainage past the tab.

In the system described above, condensate drains through the main steam duct, permitting elimination of separate condenser drain piping, equalizing lines, drain pots and pumps. The condensate continually flows in a direction counter to the incoming stream so that any Subcooling and resultant dissolved oxygen will be substantially eliminated. This eliminates the need for a dearator and also reduces corrosion of ferrous metals in the steam cycle.

Although some exemplary embodiments of the invention have been described above by way of example only, it will be understood by those skilled in the field that modifications may be made to the disclosed embodiments without departing from the scope of the invention, which is defined by the appended claims.

I claim:

1. An air-cooled condensing system, comprising:

a first stage condenser comprising a plurality of air-cooled fin tubes connected in parallel and each having an upper end and a lower end, a first steam distribution header connected to supply steam to both ends of the tubes, whereby an upper condensing (K) section and a lower dephlegmator (D) section are formed in each tube, whereby condensate forming in the K section flows down each tube in the same direction as the incoming steam and condensate in the D section of the tube flows against the direction of the incoming steam;

at least one steam extraction duct connected to the first stage condenser for extraction of steam which is not condensed in the first stage condenser;

a second stage condenser comprising a plurality of air-cooled fin tubes connected in parallel and each having an upper end and a lower end, and a second steam distribution header at the lower end of the second stage condenser; and the steam extraction duct of the first stage condenser being connected to the second steam distribution header, whereby the second stage condenser operates as a dephlegmator (D) section.

2. The system as claimed in claim 1, wherein the steam extraction duct is connected to the upper ends of the fin tubes of the first stage condenser.

3. The system as claimed in claim 1, wherein each fin tube of the first stage condenser has a leading edge facing a cooling air flow and a trailing edge facing away from the cooling air flow, and the steam extraction duct is connected to the trailing edge of the fin tube in a central region of the tube.

4. The system as claimed in claim 1, wherein the second stage condenser is smaller than the first stage condenser.

5. The system as claimed in claim 4, wherein the second stage condenser has a size equal to between 5% and 10% of the size of the first stage condenser.

6. The system as claimed in claim 1, wherein the first steam distribution header extends along the lower ends of the fin tubes in the first stage condenser and is directly connected to the lower end of each first stage fin tube, and a main steam duct is connected to a first end of the first steam distribution header for supplying steam to be condensed to the header.

7. The system as claimed in claim 6, wherein the first steam distribution header has a lower surface which steps downwardly towards the main steam duct, the first steam distribution header further comprising means for collecting condensate draining from the fin tubes.

8. The system as claimed in claim 7, further comprising a condensate collection tank connected to the main steam duct for collecting condensate draining along the first steam distribution header, whereby condensate flows under gravity to the condensate collection tank against the incoming steam flow through the main steam duct and first steam distribution header.

9. The system as claimed in claim 6, further comprising at least one steam transfer pipe connected between the first steam distribution header and the upper ends of the first stage fin tubes for delivering steam to the K section of each fin tube.

10. The system as claimed in claim 9, wherein the first stage fin tubes have an air inlet side facing a cooling air flow over the fin tubes, and the steam transfer pipe is located on the air inlet side of the fin tubes.

11. The system as claimed in claim 1, wherein each first stage fin tube is of elongate cross-section comprising a central rectangular portion and rounded opposite end portions, and at least one internal rib extends along the length of each first stage fin tube to separate the central portion from one end portion, the central rectangular portion of the fin tube comprising a condensing flow channel and the separated end portion comprising a side flow extraction channel for steam and non-condensibles which is connected to the steam extraction duct, the internal rib having at least one opening for passage of steam and non-condensibles from the condensing flow channel to the extraction channel.

12. The system as claimed in claim 11, wherein the internal rib has a central portion having a plurality of openings connecting the condensing flow channel to the extraction channel.

13. The system as claimed in claim 12, wherein the openings extend at spaced intervals over a central portion of the fin tube having a length equal to approximately one third of the total fin tube length.

14. The system as claimed in claim 12, wherein the openings are of different sizes, the opening size increasing with distance away from the steam extraction duct.

15. The system as claimed in claim 12, wherein the openings comprise elongate slots.

16. The system as claimed in claim 11, wherein the extraction channel is positioned in a region of the fin tube having no fins.

17. The system as claimed in claim 11, wherein each first stage fin tube has a leading edge facing the oncoming cooling air flow and a trailing edge facing away from the oncoming cooling air flow, and the extraction channel is located on the trailing edge of each first stage fin tube.

18. The system as claimed in claim 11, wherein two internal ribs extend along the length of each first stage fin tube to separate the central portion from each end portion, the central rectangular portion of the fin tube comprising a condensing flow channel and at least one of the separated end portions comprising an extraction channel for steam and non-condensibles.

19. The system as claimed in claim 18, wherein both separated end portions comprise extraction channels for extraction of steam and non-condensibles, the extraction channels each being connected at their upper ends to the steam extraction duct.

20. The system as claimed in claim 18, wherein each first stage fin tube has a leading edge facing the oncoming cooling air flow and a trailing edge facing away from the oncoming cooling air flow, and only one of said separated end portions comprises an extraction channel for extraction of steam and non-condensibles, the extraction channel being located on the trailing edge of each first stage fin tube.

21. The system as claimed in claim 11, further comprising a single combination steam feed and extraction header connected to the upper end of each fin tube, the header having a divider separating the header into a first, steam feed portion connected to the condensing flow channel and a second, extraction portion connected to the extraction channel for extraction of steam and non-condensibles.

22. The system as claimed in claim 21, wherein the steam feed portion of the header is connected to the first steam distribution header and the extraction portion of the header is connected to the steam extraction duct.

23. The system as claimed in claim 1, wherein the first steam distribution header is connected to the lower ends of the first stage fin tubes and has a lower end comprising a loop seal for collecting condensate draining from the first stage fin tubes.

24. The system as claimed in claim 23, further comprising a condensate transfer pipe connected between the lower end of the second steam distribution header and the loop seal in the first steam distribution header.

25. The system as claimed in claim 1, wherein the first stage condenser comprises at least one bundle of fin tubes extending parallel to one another, the first steam distribution header being connected to the lower ends of the fin tubes and an upper steam distribution and extraction header being connected to the upper ends of the fin tubes, each fin tube having a core tube of elongate transverse cross section having a central finned region and opposite end regions having no fins, a set of parallel fins extending in each direction from opposite sides of the finned central region of the core tube.

26. The system as claimed in claim 25, wherein the fins between adjacent core tubes are formed integrally as a single set of fins.

27. The system as claimed in claim 11, wherein the extraction channel has a lower end connected to the first steam distribution header.

28. The system as claimed in claim 27, further comprising a transverse tab extending across part of the cross-sectional area of the extraction channel at a location spaced between the lower and upper end of the fin tube, the tab comprising means for blocking steam flow upwardly while allowing condensate to drain downwardly past the tab.

29. The system as claimed in claim 28, wherein the internal rib has a plurality of openings, at least one opening being located beneath the tab between the tab and the lower end of the fin tube for steam flow between the central condensing channel and the extraction channel.

30. The system as claimed in claim 11, wherein the width of the central rectangular portion of each first stage fin tube is in the range from 10 to 12 mm.

31. The system as claimed in claim 1, further comprising a first air moving device for directing a cooling air flow over the first stage condenser fin tubes and a separate, second air moving device for directing a cooling air flow over the second stage condenser fin tubes.

32. The system as claim in claim 31 wherein the air moving devices comprise first and second stage fans and the fans are operated at different speeds, dependent on ambient air conditions, the first stage fan speed being decreased and the second stage fan speed being increased during colder ambient conditions.

33. A steam condensing method, comprising the steps of:

feeding steam from a steam distribution header simultaneously to the upper and lower ends of a series of fin tubes in a first condenser stage, whereby part of the steam will be condensed in an upper portion of each fin tube comprising a condenser (K) section and part of the steam will be condensed in a lower portion of each fin tube comprising a dephiegmator (D) section;

extracting uncondensed steam and non-condensibles from each fin tube;

supplying the extracted steam and non-condensibles to the lower ends of a series of fin tubes in a second condenser stage comprising a dephlegmator (D) stage, whereby the D stage creates suction to draw uncondensed steam and non-condensibles out of the first stage fin tubes, at least the majority of the extracted steam being condensed in the second stage fin tubes; and collecting condensate from the first and second stages and conveying the collected condensate to a condensate tank.

34. The method as claimed in claim 33, wherein the extraction step comprises connecting a central region of a central condenser channel in each fin tube to at least one extraction channel extending along one end of the fin tube, and extracting steam and non-condensibles flowing through the extraction channel from the upper end of the extraction channel.

35. The method as claimed in claim 34, wherein each extraction channel is located on a trailing end of the fin tube facing away from a cooling air flow across the fin tubes.

36. The method as claimed in claim 34, wherein the step of collecting and conveying condensate comprises draining condensate from the fin tubes of each stage into the steam distribution header and conveying drained condensate by gravity along a generally downwardly stepped lower portion of the steam distribution header in the opposite direction to incoming steam flowing along the header.

37. The method as claimed in claim 36, further comprising the step of conveying condensate from the steam distribution header into a main steam duct and draining the condensate from the main steam duct into a condensate collection tank located directly below the main steam duct.

* * * * *